US008870153B2

(12) United States Patent
Ross

(10) Patent No.: US 8,870,153 B2
(45) Date of Patent: Oct. 28, 2014

(54) PRESSURE ACTIVATED RATCHETING VALVE

(75) Inventor: Richard J. Ross, Houston, TX (US)

(73) Assignee: Superior Energy Services, LLC, Harvey, LA (US)

( * ) Notice: Subject to any disclaimer, the term of this patent is extended or adjusted under 35 U.S.C. 154(b) by 588 days.

(21) Appl. No.: 12/859,455

(22) Filed: Aug. 19, 2010

(65) Prior Publication Data

US 2012/0042966 A1 Feb. 23, 2012

(51) Int. Cl.
*E21B 34/10* (2006.01)
*E21B 34/00* (2006.01)

(52) U.S. Cl.
CPC ..... *E21B 34/103* (2013.01); *E21B 2034/007* (2013.01)
USPC ..... 251/63.6; 166/323; 166/334.4

(58) Field of Classification Search
USPC ..... 251/62, 63.5, 63.6; 166/323, 334.1, 166/334.4
See application file for complete search history.

(56) References Cited

U.S. PATENT DOCUMENTS 4,667,743 A * 5/1987 Ringgenberg et al. ..... 166/321
5,180,007 A * 1/1993 Manke et al. ..... 166/321
5,518,073 A * 5/1996 Manke et al. ..... 166/240
5,765,641 A 6/1998 Shy et al.
6,397,949 B1 6/2002 Walker et al.
6,722,440 B2 4/2004 Turner et al.
7,198,109 B2 4/2007 Turner et al.
7,303,020 B2 * 12/2007 Bishop et al. ..... 166/374
7,665,526 B2 2/2010 Turner et al.
2008/0001111 A1 1/2008 Ross
2009/0065217 A1 3/2009 Ross
2009/0229828 A1 9/2009 Ross

* cited by examiner

*Primary Examiner* — William McCalister
(74) *Attorney, Agent, or Firm* — Jones Walker, LLP

(57) ABSTRACT

A pressure actuated valve is disclosed which includes a plurality of flow openings, and first and second pistons. The first and second pistons are independently actuatable relative to one another, and are releasable coupled to one another by a release sleeve. The pressure actuated valve also includes a closing sleeve that is operatively coupled to the second piston. In an initial position of the second piston, the closing sleeve covers or blocks the plurality of flow openings. The pressure actuated valve includes a ratchet mechanism coupling the release sleeve to the first piston, the ratchet mechanism being adapted to allow movement of the first piston between its initial position and an intermediate position and back to its initial position while allowing the release sleeve to release the second piston after a predetermined number of cycles of movement of the first piston between its initial position and the intermediate position and back to its initial position. Upon release of the second piston by the release sleeve, the second piston, and the closing sleeve, responsive to the urging of a spring, will move to its final position uncovering the plurality of flow openings. The ratchet mechanism allows for the incremental movement of a release sleeve in response to movements of the first piston. The release sleeve is adapted to open the pressure actuated valve upon movement of the release sleeve through a designated distance.

23 Claims, 26 Drawing Sheets

PRESSURE ACTIVATED RATCHETING VALVE

FIELD OF THE DISCLOSURE

The present application relates generally to the field of well completion assemblies for use in a wellbore and, more specifically, to a method and apparatus for opening a pressure actuated valve controlling fluid flow between an annulus and an interior of a production zone within a tubing string in a wellbore.

DESCRIPTION OF THE RELATED ART

Mechanical sleeve valves, such as BJ Services Company's family of Multi-Service Valves, are used in subterranean wells to provide zone isolation and bore completion control for completion operations such as gravel packing, spot acidizing and fracturing, killing a well, or directing flow from the casing to the tubing in alternate or selective completion operations. In such operations, the sleeve valve provides fluid communication between the tubing string, such as the inner diameter of the valve, and the outside of the valve, such as a well annulus. Typically, mechanical sleeve valves are opened or closed, such as by a shifting tool that is placed within the valve body and manipulated by standard wireline and/or coiled tubing methods. The sleeve, which seals the fluid communication path, can be physically moved from the closed to opened position, and vice versa, by these methods.

There also exist hydraulically actuated sleeve valves, such as Well Dynamics' CC Interval Control Valve, in which opening and closing of the valve is achieved remotely with the use of one or more hydraulic control lines. In these types of hydraulic sleeve valves, a pressure differential across a defined piston area causes the sleeve to move in the desired direction.

Other sleeve valves operate by applying or increasing pressure in the downhole bore to unlock the sleeve valve and then bleeding the applied pressure to allow the valve to open using mechanical means, such as a compressed spring, for example. There are times when an operator would like to pressurize and bleed the pressure in the downhole bore without opening the sleeve valve. Currently, one of the methods to accomplish this is to shear pin the valve in the closed position requiring relatively high pressure to shear the pin and open the valve. Any operations requiring the downhole bore to be pressurized prior to opening the valve is limited to a somewhat lower pressure.

Locking the sleeve valve closed with a shear pin is both inconvenient and hazardous. A possibility of over pressurizing the downhole bore and opening the sleeve valve prematurely always exists. Alternatively, using a shear pin that requires a sufficiently high pressure to avoid premature opening poses a hazard when the downhole bore is pressurized at the high pressure required to shear the pin and unlock the valve.

What is needed is an improved hydraulic sleeve valve that allows the downhole bore to be pressurized one or more times without premature opening of the sleeve valve and without the hazards presented by the requirement to set the shear pressure a very high level.

SUMMARY OF THE DISCLOSURE

The present disclosure provides a system which allows an operator to pressurize and bleed a downhole bore without premature opening of a sleeve valve and not requiring the use of a mechanical tool to manually shift the valve. In one embodiment, a double ratchet assembly adapted for moving a valve release sleeve in a first direction and preventing movement of the release sleeve in a second direction opposite the first direction includes a release sleeve having an outer diameter and an outer surface; the release sleeve enclosed in and surrounded by an outer housing, the inner diameter of the outer housing being greater than the outer diameter of the release sleeve and forming an annular void between the outer housing and the release sleeve. An upper housing connector is connected to a proximal end of the outer housing adjacent to the release sleeve; a lower housing connector is connected to a distal end of the outer housing adjacent to the release sleeve. A release piston is disposed within the annular void between the outer housing and the release sleeve, the release piston being moveable in the annular void between the upper connector and the lower connector. A first ratchet mechanism having an inner and outer surface, the inner surface of the first ratchet mechanism adapted to selectively engage the release sleeve and a first ratchet carrier having an inner surface adapted to selectively engage the outer surface of the first ratchet mechanism, the first ratchet carrier moving the release sleeve in a first direction in response to the release piston moving in the first direction. A second ratchet mechanism having an inner and outer surface, the inner surface of the second ratchet mechanism adapted to selectively engage the release sleeve and a second ratchet carrier having an inner surface adapted to selectively engage the outer surface of the second ratchet mechanism. The second ratchet mechanism allowing motion of the release sleeve in the first direction, but preventing movement of the release sleeve in a second direction in response to the release piston moving in the second direction. A spring disposed within the annular void and between the upper connector and the release piston biasing the release piston in the second direction.

In another embodiment, a rotating ratchet assembly adapted for moving a release sleeve in a first direction includes a release sleeve having an outer diameter and an outer and inner surface, and a housing assembly having a proximal end and a distal end, and an inner diameter greater than the outer diameter of the release sleeve, the housing assembly surrounding the release sleeve. A release piston having a proximal end and a distal end is disposed within the housing assembly; the proximal end of the release piston is disposed adjacent to and spaced from a proximal end of the release sleeve. A ratchet mechanism is disposed between the proximal end of the release piston and the proximal end of the release sleeve, the ratchet mechanism adapted to rotate in a direction transverse to a motion of the release piston in response to the motion of the release piston. The ratchet mechanism is adapted to move the release sleeve in a first direction when the ratchet mechanism has rotated through a first predetermined radial angle. A spring is disposed within the annular void between the housing connector and the release piston biases the release piston in a second direction.

In one embodiment of the present disclosure, a pressure actuated valve ("PAV") is adapted to be positioned in a subterranean well bore having at least an upper zone and an upper zone pressure. A PAV as described herein includes a plurality of flow openings through the wall of a pipe or tubing, and a first piston (also referred to herein as a "release piston") and a second piston (also referred to herein as a "valve piston"), wherein the first and second pistons are independently actuatable relative to one another. The PAV also includes a closing sleeve that is operatively coupled to the second piston. The closing sleeve is adapted to be positioned so as to block or not block the plurality of flow openings. In an initial position of the second piston, the closing sleeve covers or blocks the plurality of flow openings. The first piston is movable when a pressure within the valve is greater than an upper zone pressure in the well, while the second piston is movable when the pressure within the valve is approximately equal to or less than the upper zone pressure within the well. The PAV also comprises a first biasing mechanism or spring positioned proximate the first piston (release piston), the first spring being adapted to apply a biasing force to the first piston so as to urge the first piston to move towards its initial position. The first piston is coupled to the second piston by a release sleeve. The valve also includes a plurality of actuatable members, such as spring actuated dogs, that engage the second piston when the first and second pistons are in their initial positions and thereby secure the second piston in its initial position. The second piston is secured in its initial position until unlocked and released by a predetermined number of cycles of reciprocal movement of the first piston. The PAV also comprises a second biasing mechanism or spring positioned proximate the second piston (valve piston), the spring being adapted to apply a biasing force to the second piston so as to urge the second piston to move toward a final position so as to uncover the plurality of flow openings. The PAV includes a ratchet mechanism coupling the release sleeve to the first piston, the ratchet mechanism being adapted to allow movement of the first piston between its initial position and the intermediate position and back to its initial position while allowing the release sleeve to release the second piston after a predetermined number of cycles of movement of the first piston between its initial position and the intermediate position and back to its initial position. Upon release of the second piston by the release sleeve, the second piston, and the closing sleeve, responsive to the urging of the second spring, will move to its final position uncovering the plurality of flow openings.

An improved hydraulic sleeve valve for use in subterranean wells is disclosed. The valve comprises a body having a plurality of flow ports allowing communication from outside the body to inside the body. A movable sleeve may be sealed to the inside of the body such that in one position the sleeve prevents flow through the body flow ports and in another position flow therethrough is facilitated. The sleeve may be moved from the closed position to the opened position by a pressure differential which may be applied across one or more pistons associated with the sleeve. The improved sleeve valve comprises a first piston or a release piston that provides a ratcheting action to unlock the valve as a result of repeated pressure applications to the release piston. The sleeve valve is then opened by a spring-biased second piston or valve piston.

BRIEF DESCRIPTION OF THE DRAWINGS

The following figures, in which like numerals indicate like elements, form part of the present specification and are included to further demonstrate certain aspects of the present application. The present application may be better understood by reference to one or more of these figures in combination with the detailed written description of specific embodiments presented herein.

Figure 1A:
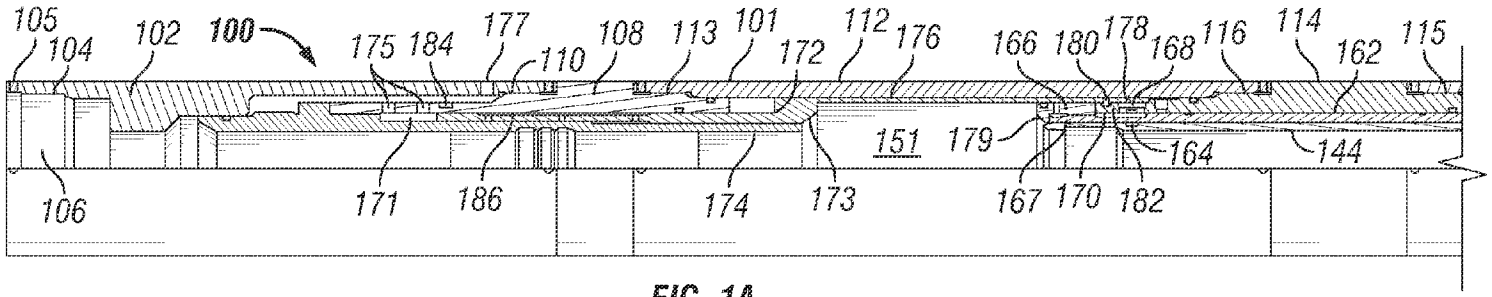
FIG. 1A (Prior Art)
FIGS. 1A, 1B and 1C illustrate a cross-sectional side view of a prior art pressure activated control valve in a locked-closed configuration.

These and other embodiments of the present application will be discussed more fully in the following detailed description. The features, functions, and advantages can be achieved independently in various embodiments of the present application, or may be combined in yet other embodiments. The figures and detailed descriptions of these specific embodiments are not intended to delimit all embodiments of the disclosure or to limit the breadth or scope of the described concepts or the appended claims in any manner. Rather, the figures and detailed written descriptions are provided to illustrate the disclosed concepts to a person of skill in the art.

DETAILED DESCRIPTION

One or more illustrative embodiments incorporating the disclosure described herein are presented below. Not all features of an actual implementation are necessarily described or shown for the sake of clarity. For example, the various seals, vents, joints and others design details common to oil well equipment are not specifically illustrated or described. It is understood that in the development of an actual embodiment incorporating the present disclosure, numerous implementation-specific decisions must be made to achieve the developer's goals, such as compliance with system-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

As used within this description, relative and positional terms, such as, but not limited to "up" and "down", "upward" and "downward", "upstream" and "downstream", "upper" and "lower", "upwardly" and "downwardly", and other like terms are used in this description to more clearly describe some embodiments of the disclosure. In various ones of the figures, the drawings may be oriented horizontally; in such figures, the left side of the figure is "up" or "uphole" and the right side of the figure is "down" or "downhole." However, when applied to apparatus and methods for use in wells that are deviated or horizontal, such terms may refer to a "left to right", "right to left", or other relationship as appropriate. Also, as used herein the terms "seal" and "isolation" are used with the recognition that some leakage may occur and that such leakage may be acceptable.

An improved hydraulic sleeve valve for use in subterranean wells is disclosed. The valve comprises a body having a plurality of flow ports allowing communication from outside the body to inside the body. A movable sleeve may be sealed to the inside of the body such that in one position the sleeve prevents flow through the body flow ports and in another position flow therethrough is facilitated. The sleeve may be moved from the closed position to the opened position by a pressure differential which may be applied across one or more pistons associated with the sleeve. The improved sleeve valve comprises a release piston that provides a ratcheting action to unlock the valve as a result of repeated pressure applications to the release piston. The sleeve valve is then opened by a spring-biased valve piston.

Referring now to FIGS. 1A-3C, a cross-sectional side view of a prior art pressure actuated control valve 100 ("PAC"). PAC 100 generally comprises an outer housing or tube 101 constructed of several sections. A top connector housing 102 is disposed at the upper end of the PAC 100. The top connector housing 102 includes an internally threaded portion 104 and a set screw 105 at the top end thereof for receiving and coupling to an externally threaded stub 106. At the lower end of the top connector housing 102, the upper end of a release piston carrier 108 is received by an internally threaded portion 110 thereby coupling the release piston carrier 108 to the top connector housing 102. Housing extension 112 is coupled to the lower end of the release piston carrier 108 and to the upper end of an upper body section 114. Each end of the housing extension 112 is internally threaded to engage externally threaded portions 113 and 116 at the lower end of the release piston carrier 108 and the upper body section 114, respectively. A housing lower body section 118 is coupled to the lower end of the upper body section 114 and to the upper end of a lower housing section 120. The upper and lower ends 115 and 117, respectively, of the housing lower body section 118 are threaded and are received by corresponding threaded sections of the upper body section 114 and the lower housing section 120. An externally threaded upper end 121 of a housing connector 122 is received by and coupled to a corresponding internally threaded lower end of lower housing section 120. The externally threaded lower end 123 of the housing connector 122 is received by an internally threaded upper end of and coupled to a lower cross-over section 124.

An inner housing or tube 130 is generally constructed within a lower portion of the outer housing of the PAC 100 and extends upwards from the bottom or lower end of the PAC 100. An inner housing section 132 is disposed within and concentric with the PAC 100 outer housing 101. An externally threaded portion of the upper end 134 of the inner housing section 132 is received by and coupled to a corresponding internally threaded portion 136 of the lower housing section 120 and is securely held in position with set screw 135. The inner housing section 132 is spaced from the outer housing 101. A number of fluid ports 133 are formed around the circumference of the inner housing section at the upper end of the inner housing 132. An inner lower connector section 138 is spaced from and disposed within and concentric with the outer housing 101 below the inner housing section 132. An externally threaded portion of the upper end 140 of the inner lower connector section 138 is received by and coupled to a corresponding internally threaded portion 142 of the inner housing section 132 and is securely held in position with set screw 141. An annular space is formed between the inner housing 130 and the lower portion of the outer housing 101 which defines a fluid flow path 150 to communicate fluid between the inner housing 130 and the outer housing 101 to the fluid ports 133. A closing sleeve 144 is slidably disposed within the inner housing 130 adjacent to the inner housing section 132 and extends upwards within the PAC 100. A portion 146 of the closing sleeve 144 is formed to slide over the fluid ports 133 to completely restrict the flow of fluid through the ports 133 (as shown in FIGS. 1B and 2B). The lower portion of the closing sleeve 144 has a number of fluid ports 148 formed through and around the circumference of the closing sleeve 144. When the closing sleeve 144 is allowed to move in an upwardly direction within the PAC 100 until the closing sleeve fluid ports 148 are aligned with the fluid ports 133, fluid is allowed to flow from the annular space 150 between the inner housing 130 and the outer housing 101 to the inner bore or tube 151 of the PAC 100.

An annular space 152 is formed between the closing sleeve 144 and the lower housing section 120. A spring 154 is disposed in the lower portion of the annular space 152 and bears against a spring retainer ring 156 held in place by one or more retainer keys 158 inserted in through holes provided in the wall of the lower housing section 120 at the upper end of the inner housing 132. The upper end of the spring 154 bears against seal retainer ring 160. A valve piston 162 is disposed in the upper portion of annular space 152 and extends upwardly between the upper end of the closing sleeve 144 and lower and upper housing body sections 118 and 114, respectively. The lower end of valve piston 162 is internally threaded for receiving the seal retainer ring 160 and coupling it thereto. A piston cap 166 is mounted at the upper end of the valve piston 162 by a threaded portion 167. The valve piston 162 is secured to the closing sleeve 144 at its upper end by one or more shear screws 164 about the inner circumstance of the valve piston 162. The closing sleeve 144 is selectively retained in position over the fluid ports 133 by one or more actuatable members, such as spring-biased dogs 168, for example, mounted in an upper portion of upper body section 114 and extending into slot 170 formed about the outer circumference of the valve piston 162. A release piston 172 is slidably disposed in annular space 171 formed between the release piston carrier 108 and seal bore connector 174 disposed within and concentric to the PAC 100 outer housing 101. A release piston lower extension 176 extends downwardly into an annular space 178 formed between housing extension 112 and the upper end of upper body section 114 and piston cap 166.

Figure 1B:
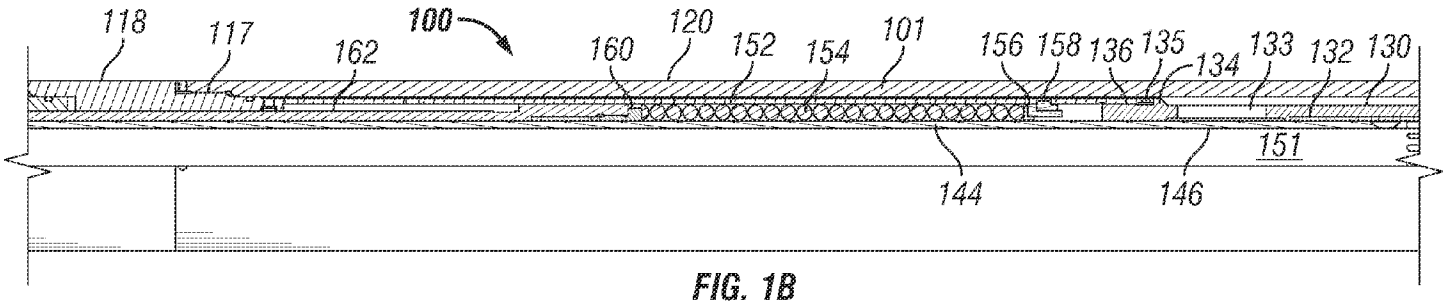
FIG. 1B (Prior Art)
Figure 1C:
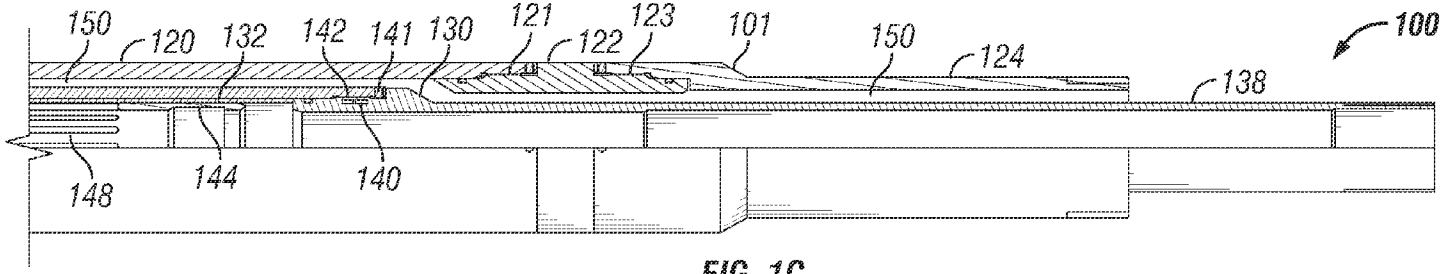
FIG. 1C (Prior Art)

Typically, the PAC 100 is run into a wellbore in a locked-closed configuration, as shown in FIGS. 1A-1C, wherein the uphole end is on the left of FIG. 1A and the downhole end is on the right end of FIG. 1C. In the locked-closed configuration, the portion 146 of the closing sleeve 144 covers the fluid ports 133. In the locked-closed configuration, the spring 154 is compressed biasing the valve piston 162 in an upwardly direction. The release piston lower extension 176 covers the spring-biased dogs 168 maintaining them in slot 170 in the valve piston 162 and preventing the valve piston 162, and thus the closing sleeve 144, from moving upwards and aligning the sleeve fluid ports 148 with the fluid ports 133. The release piston lower extension 176 is held in place by one or more shear pins 180 protruding from a portion 182 of the upper end of the upper body housing section 114 and extending through release piston lower extension 176.

Figure 2A:
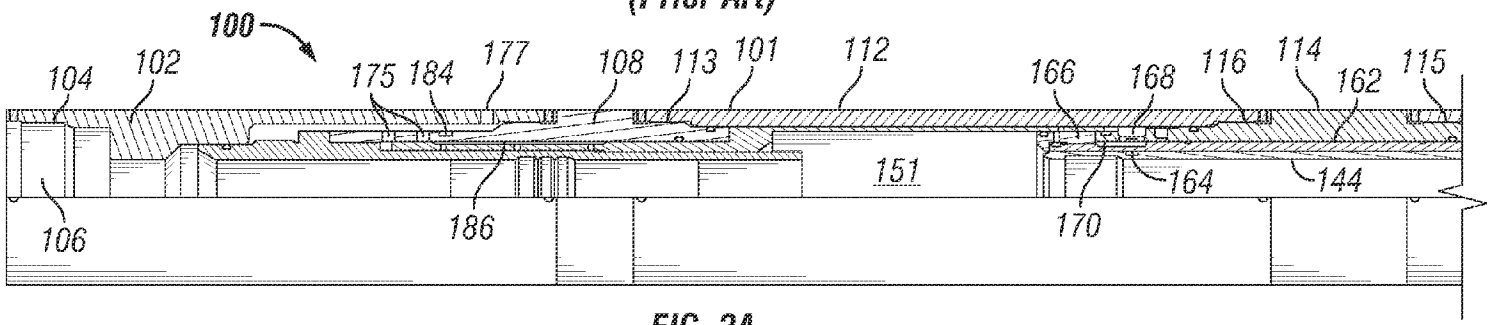
FIG. 2A (Prior Art)
FIGS. 2A, 2B and 2C illustrate a cross-sectional side view of the prior art pressure activated control sleeve valve of FIGS. 1A, 1B and 1C in an unlocked-closed configuration.
Figure 2B:
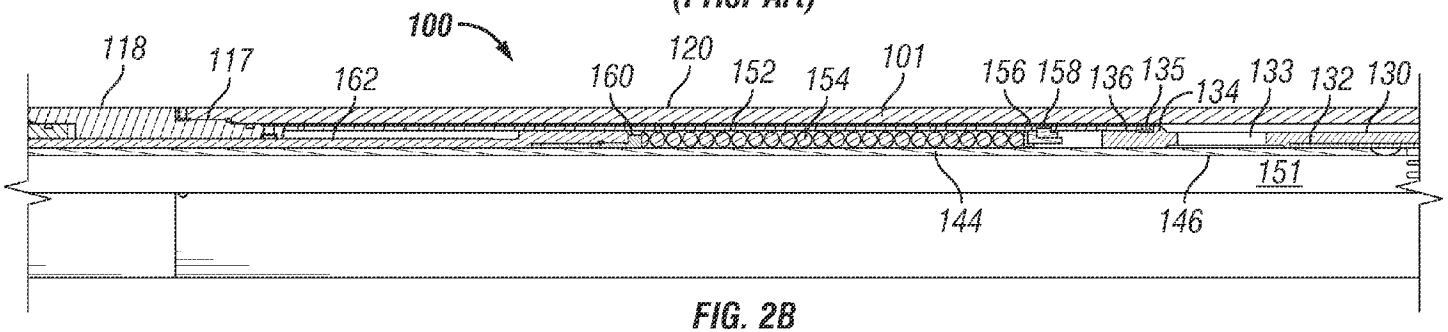
FIG. 2B (Prior Art)
Figure 2C:
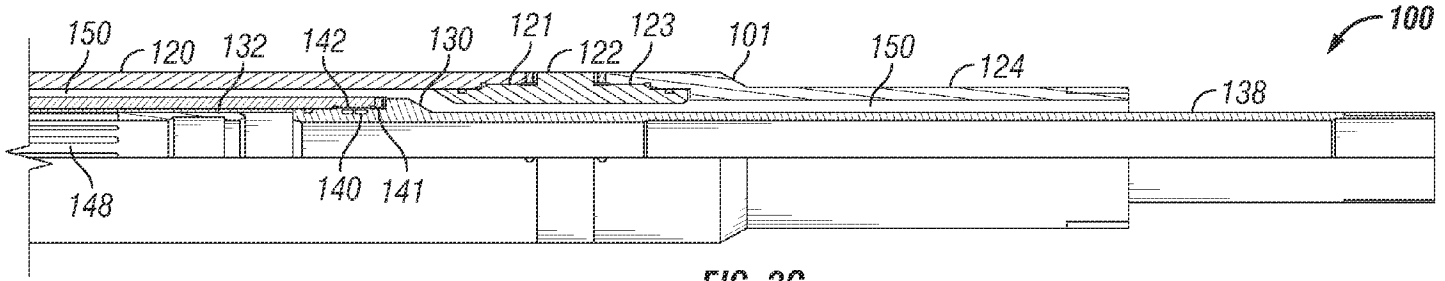
FIG. 2C (Prior Art)

The PAC 100 may be reconfigured to an unlocked-closed (sheared) configuration, as shown in FIGS. 2A-2C. The PAC 100 is unlocked by creating a pressure differential between the inner bore or tube 151 of PAC 100 and upper portion of annular space or void 171. The inner bore 151 is pressurized by pressuring down the wellbore tubing (not shown) coupled to the upper end of the top connector housing 102 via stub 106 at internally threaded portion 104. Increased pressure is thus asserted against the face 173 of the release piston 172. Vents 175 and 177 vent the annular space 171 to the exterior of the outer housing 101 creating a pressure differential across the release piston 172 driving the release piston 172 upwards in the annular space 171. The action of the release piston 172 moving upwards uncovers the release piston snap ring 184 allowing the snap ring 184 to contract slightly into an elongated annular groove 186 and prevent the release piston 172 from moving downwardly when the increased pressure in the inner bore 151 is bled off. As the release piston 172 moves upwardly, the release piston lower extension 176 shears the shear pins 180 and uncovers the spring-biased dogs 168. When the dogs 168 are uncovered, a spring, such as a leaf spring, for example, forces the dogs 168 outwardly and out of the slot 170 and the closing sleeve 144 is free to slide upwardly. As long as increased pressure is maintained in the inner bore 151, pressurized fluid bears against the face 179 of the piston cap 166 preventing the closing sleeve from sliding upwardly and opening the fluid ports 133.

Figure 3A:
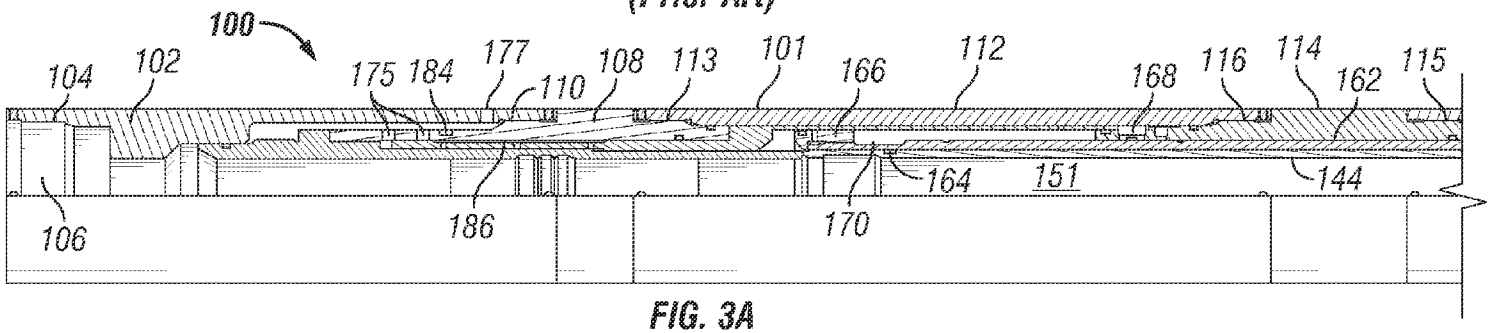
FIG. 3A (Prior Art)
FIGS. 3A, 3B and 3C illustrate a cross-sectional side view of the prior art pressure activated control valve of FIGS. 1A, 1B and 1C in an open configuration.
Figure 3B:
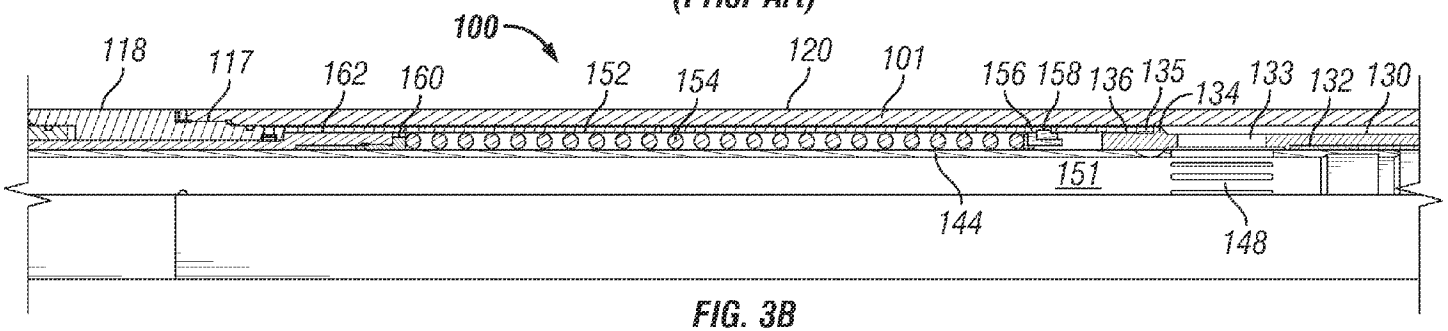
FIG. 3B (Prior Art)
Figure 3C:
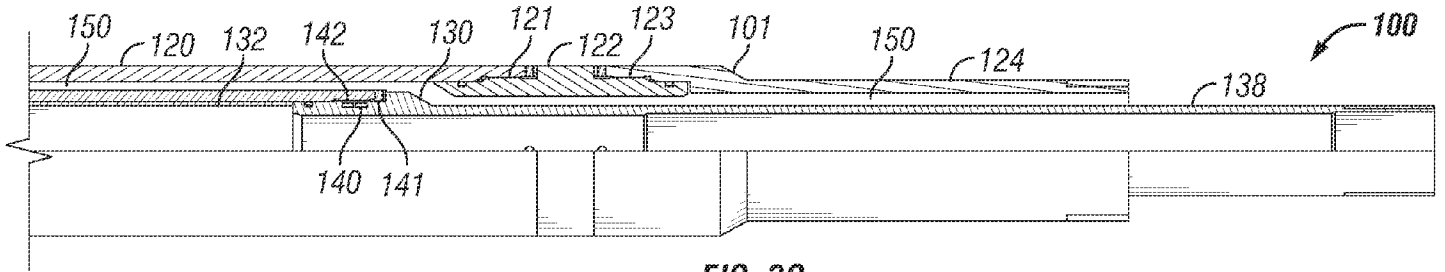
FIG. 3C (Prior Art)
Figure 4A:
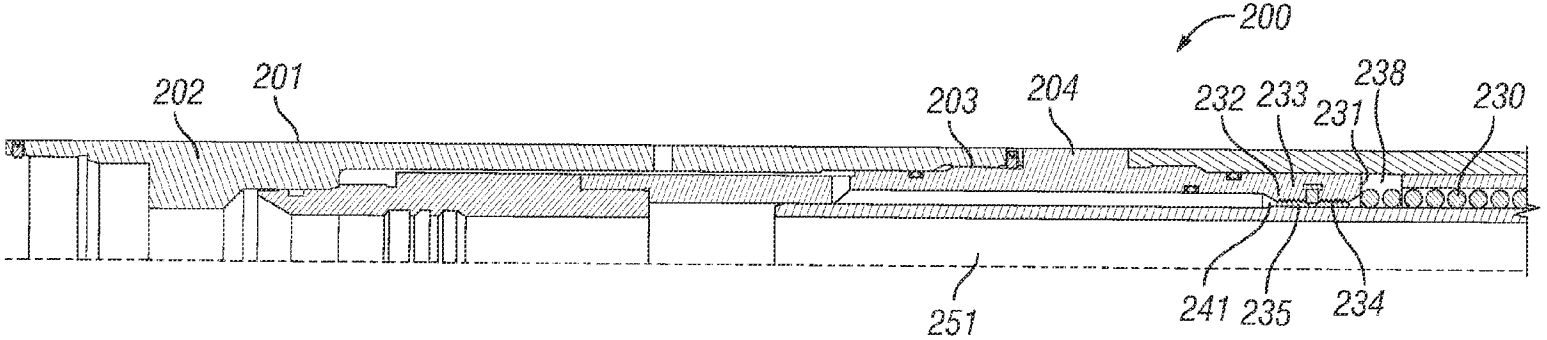
FIGS. 4A-4E illustrate a cross-sectional side view of one embodiment of a valve opening mechanism for a pressure actuated sleeve valve in a locked-closed configuration.
Figure 5A:
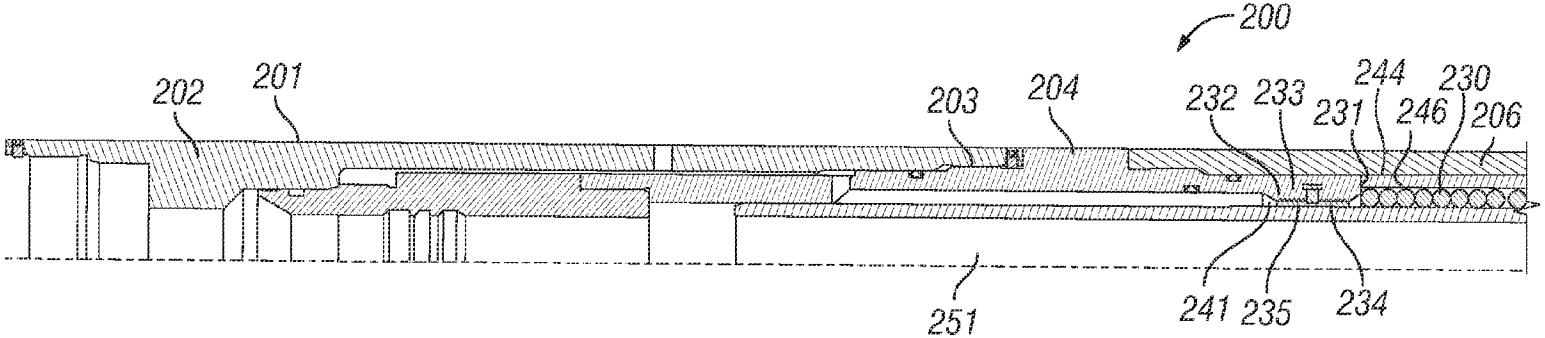
FIGS. 5A-5E illustrate a cross-sectional side view of the valve opening mechanism for a pressure actuated sleeve valve in an unlocked-closed configuration after a first tubing pressure increase cycle of the embodiment shown in FIGS. 4A-4E.
Figure 4B:
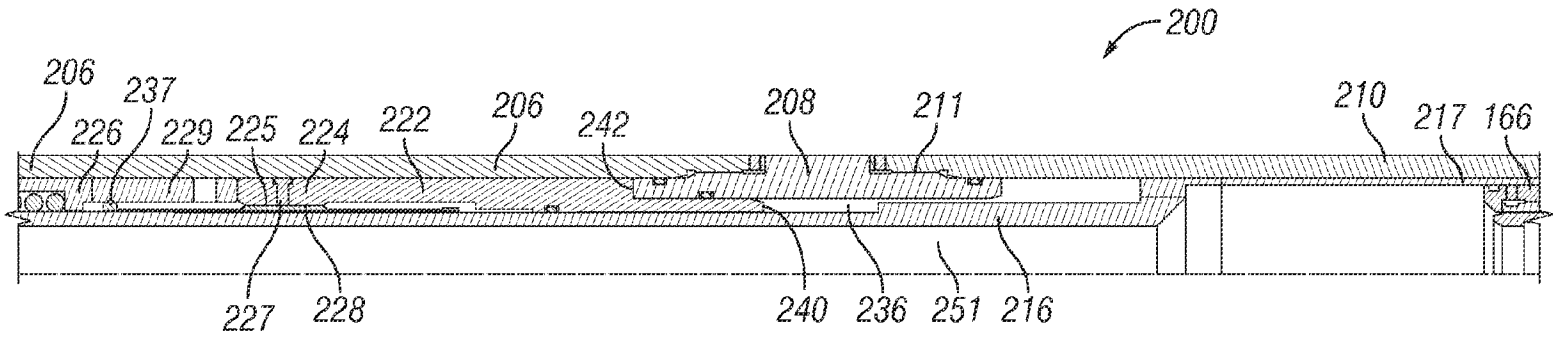
Figure 5B:
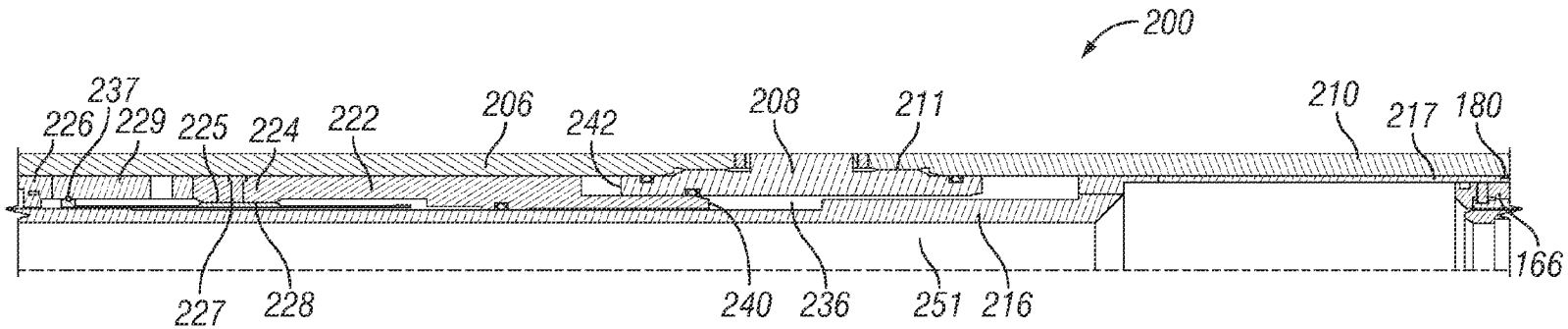
Figure 4C:
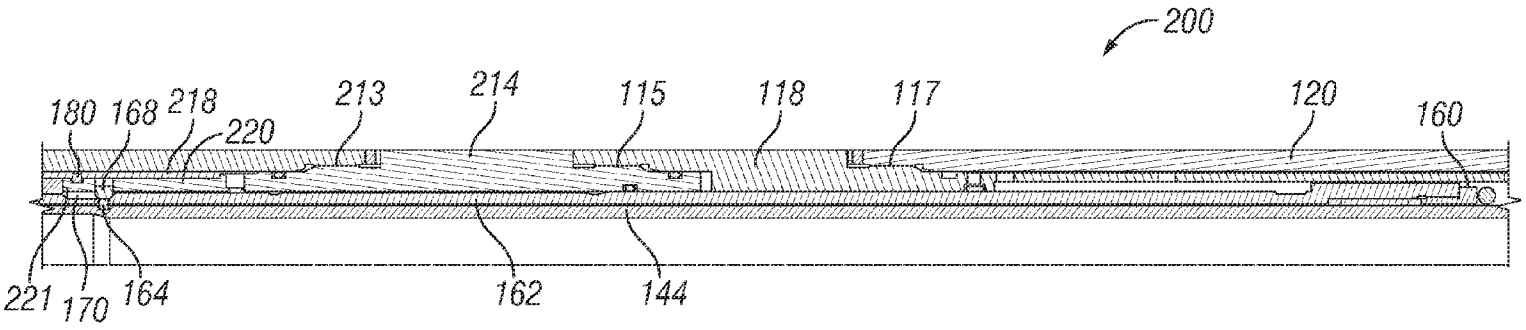
Figure 5C:
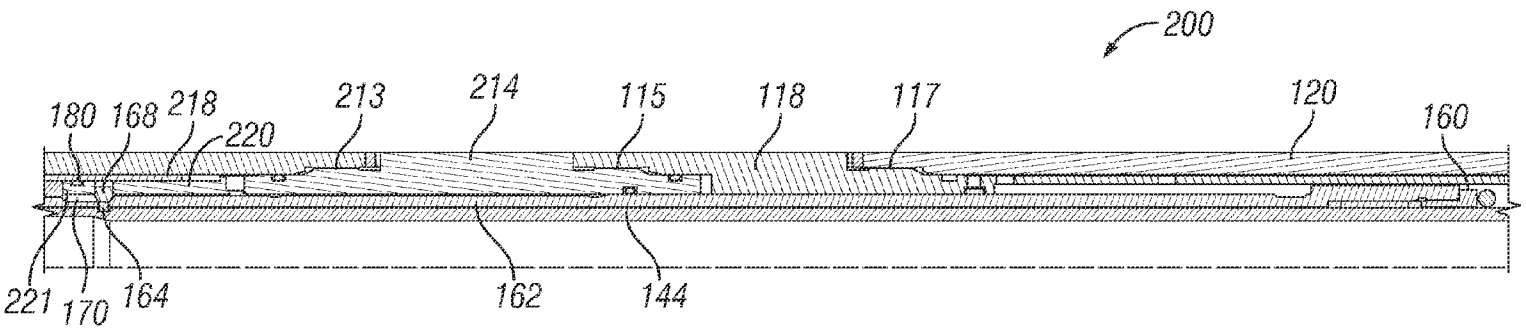
Figure 4D:
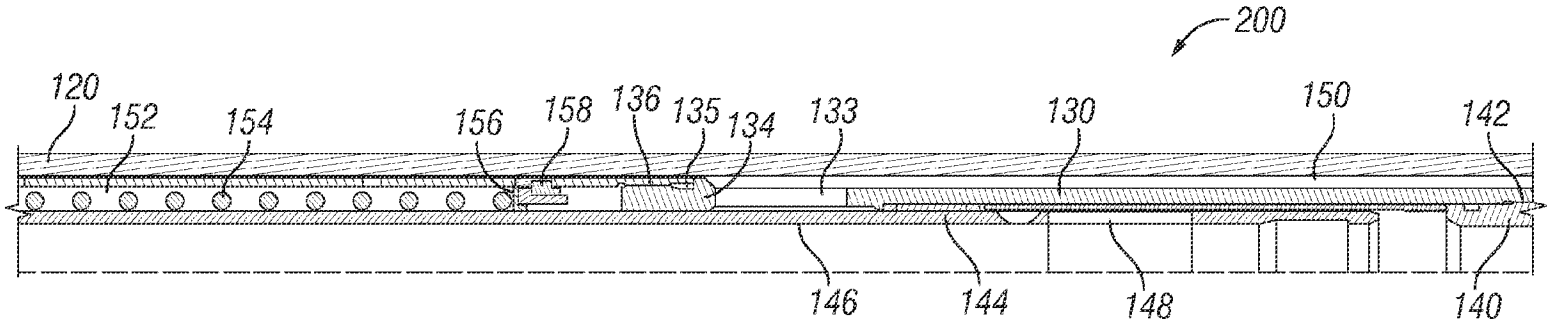
Figure 5D:
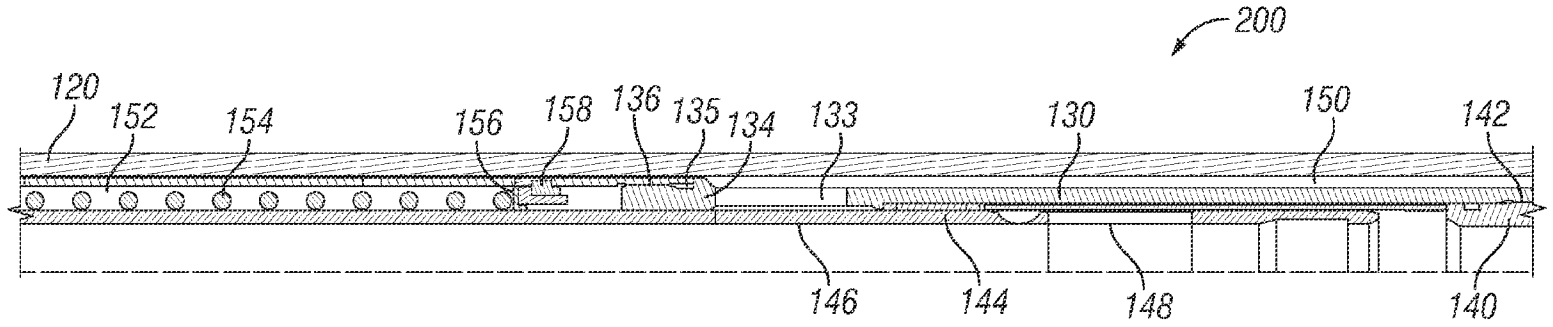
Figure 4E:
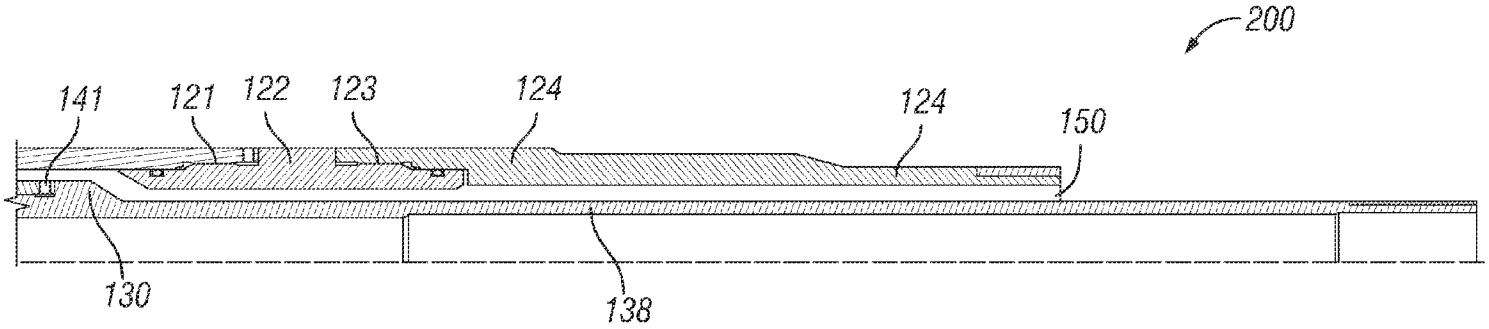
Figure 5E:
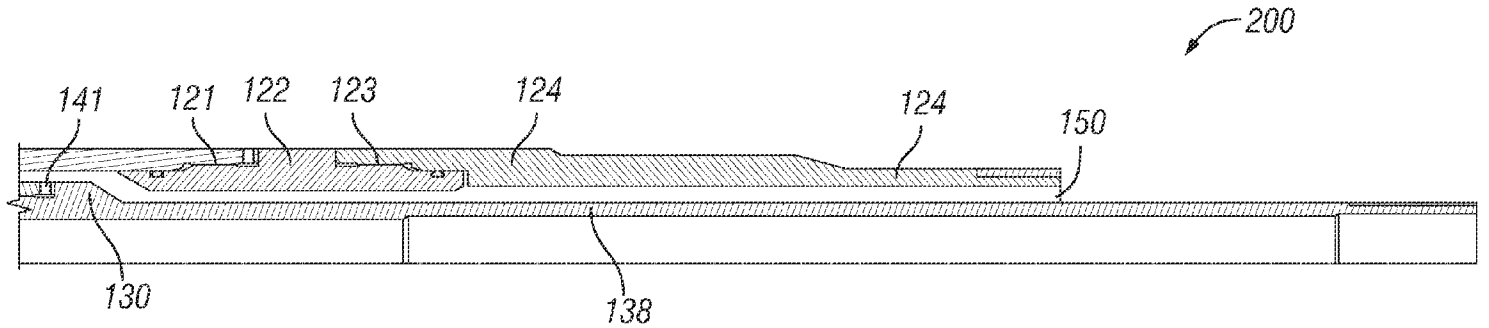
Figure 6A:
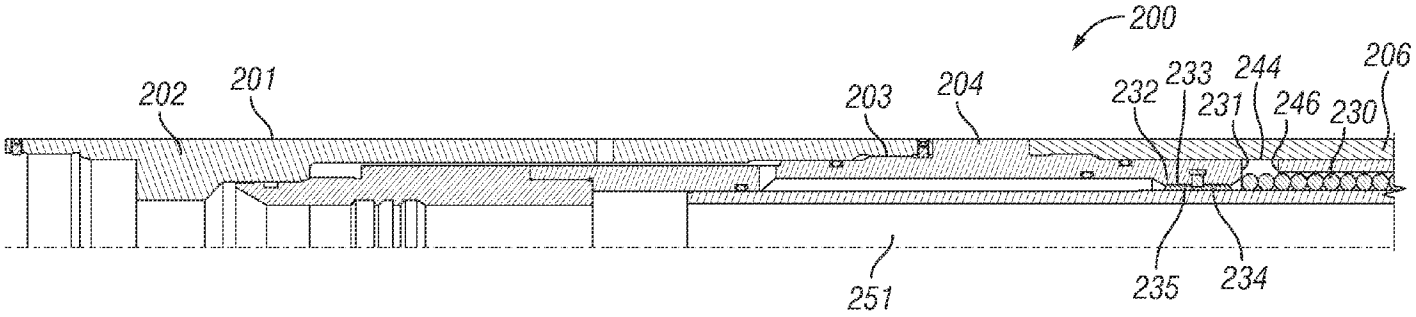
FIGS. 6A-6E illustrate a cross-sectional side view of the valve opening mechanism for a pressure actuated sleeve valve in an unlocked-closed configuration after a first tubing pressure bleed cycle of the embodiment shown in FIGS. 4A-4E.
Figure 7A:
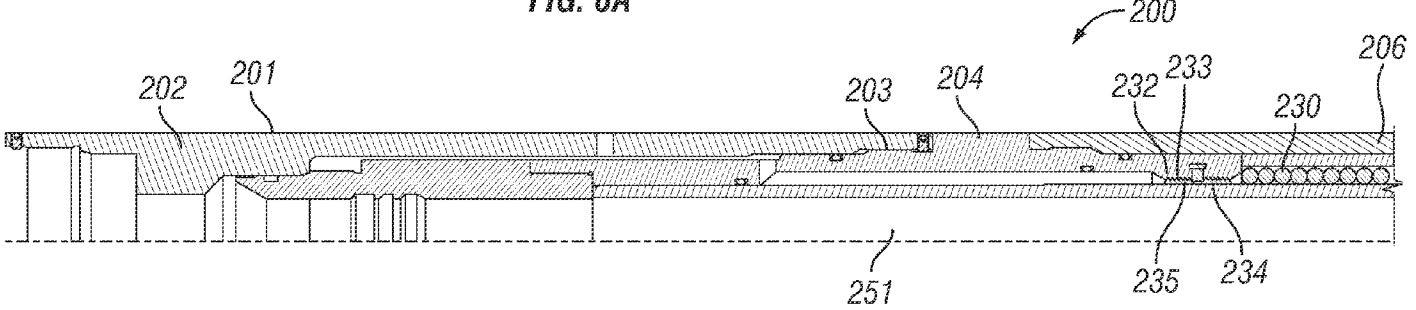
FIGS. 7A-7E illustrate a cross-sectional side view of the valve opening mechanism for a pressure actuated sleeve valve in an unlocked-closed configuration after a final tubing pressure increase cycle of the embodiment shown in FIGS. 4A-4E.
Figure 8A:
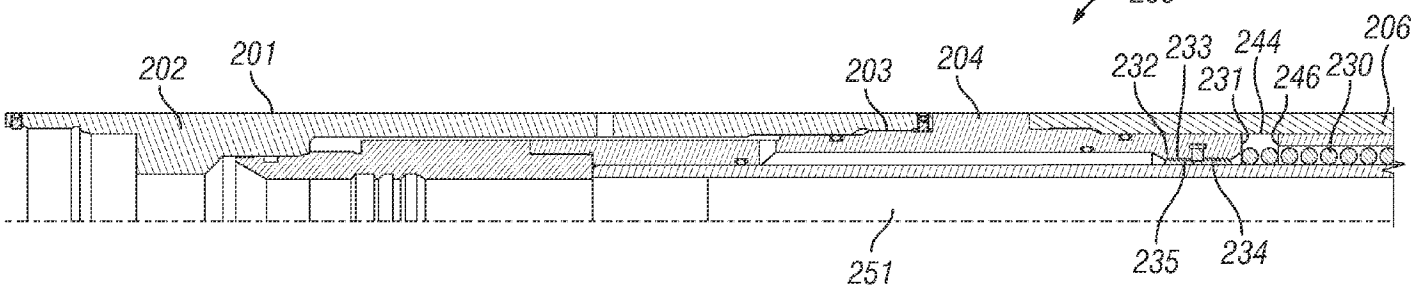
FIGS. 8A-8E illustrate a cross-sectional side view of the valve opening mechanism for a pressure actuated sleeve valve in an open configuration after a final pressure bleed cycle of the embodiment shown in FIGS. 4A-4E.
Figure 6B:
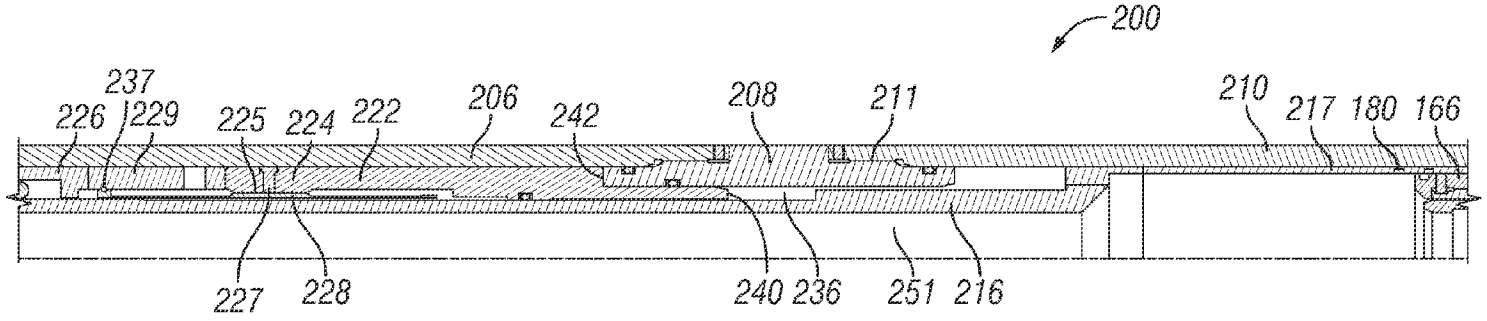
Figure 7B:
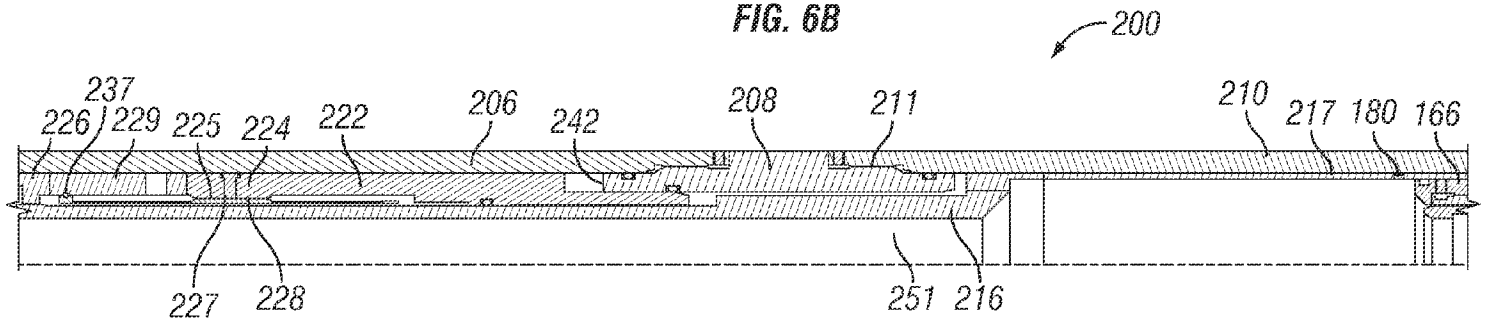
Figure 8B:
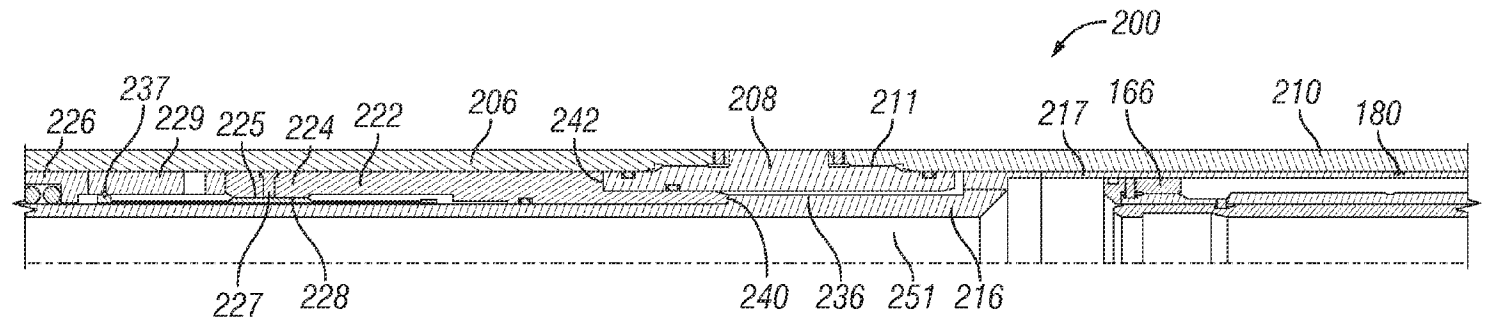
Figure 6C:
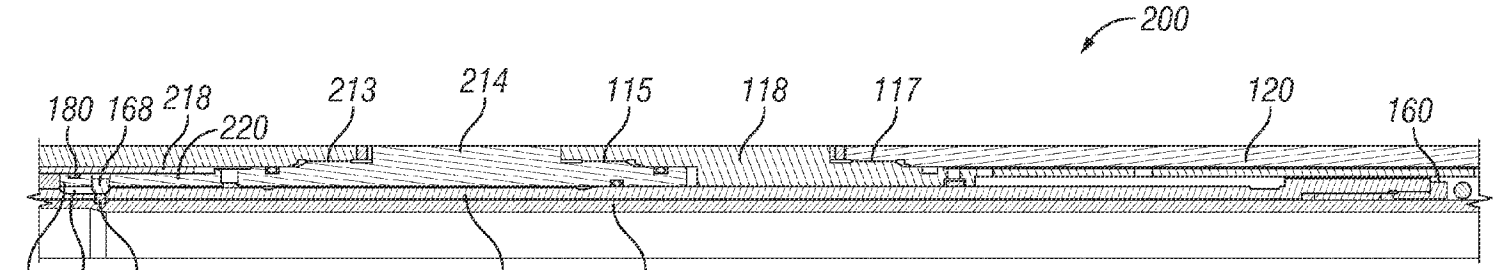
Figure 7C:
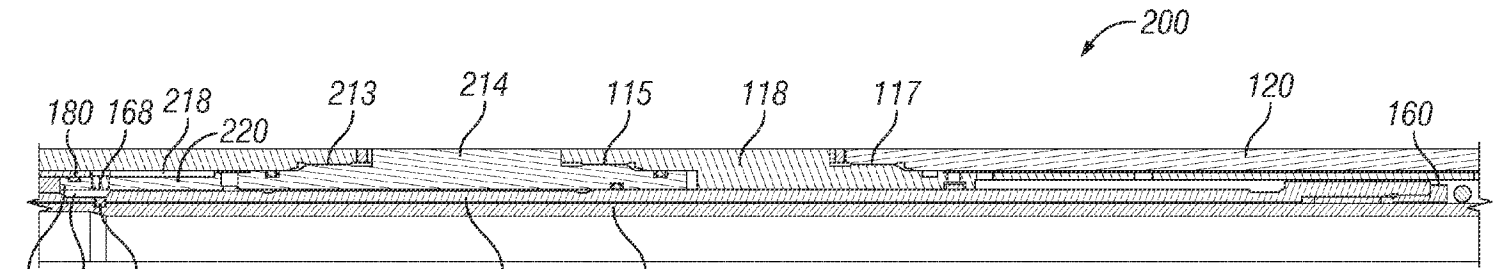
Figure 8C:
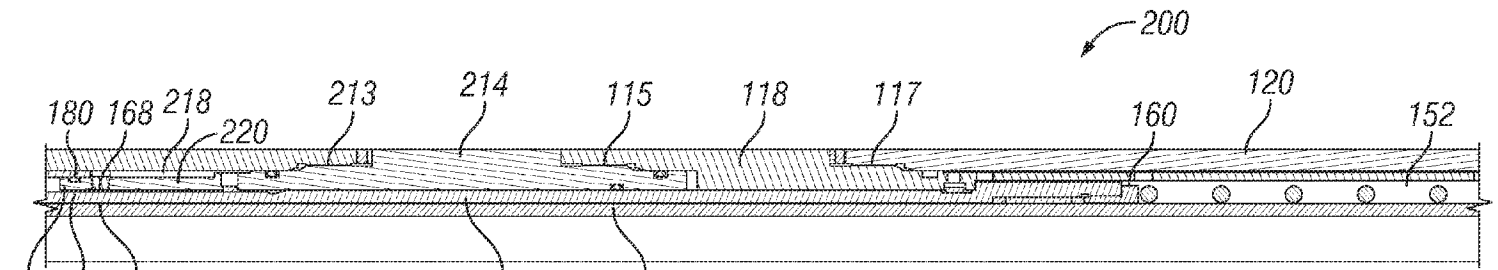
Figure 6D:
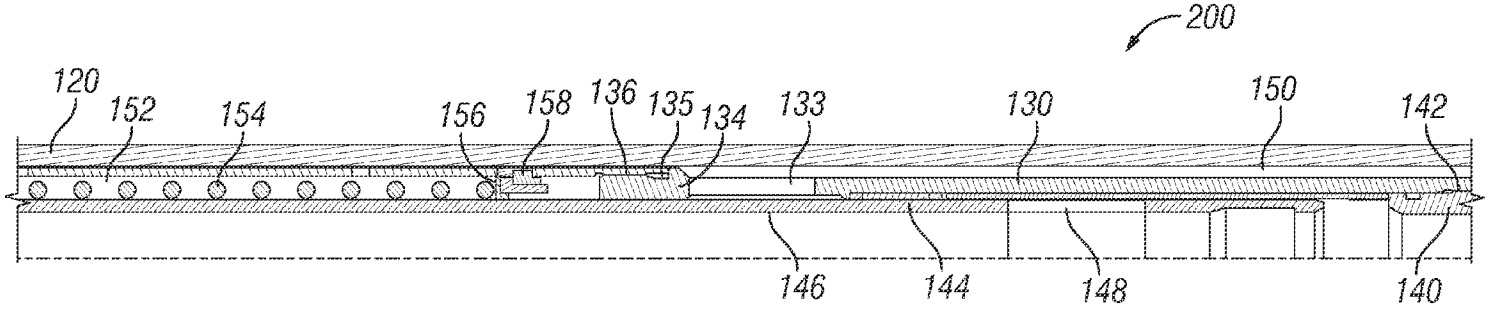
Figure 7D:
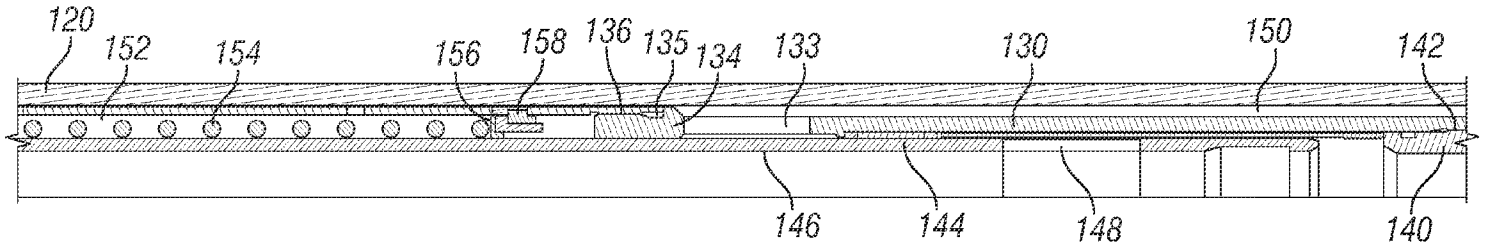
Figure 8D:
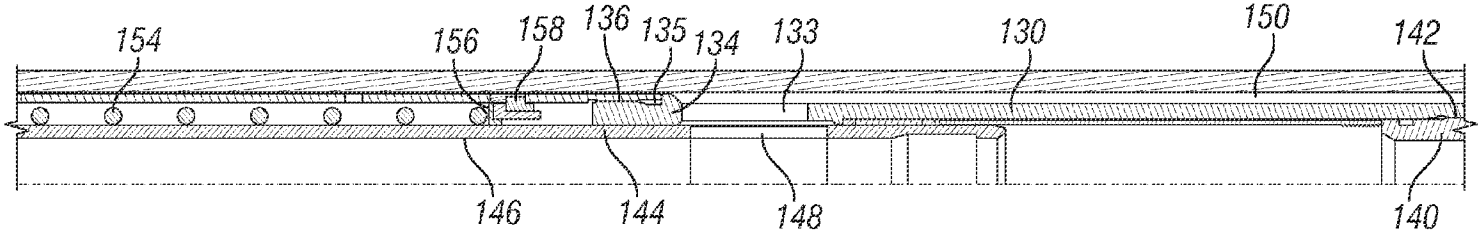
Figure 6E:
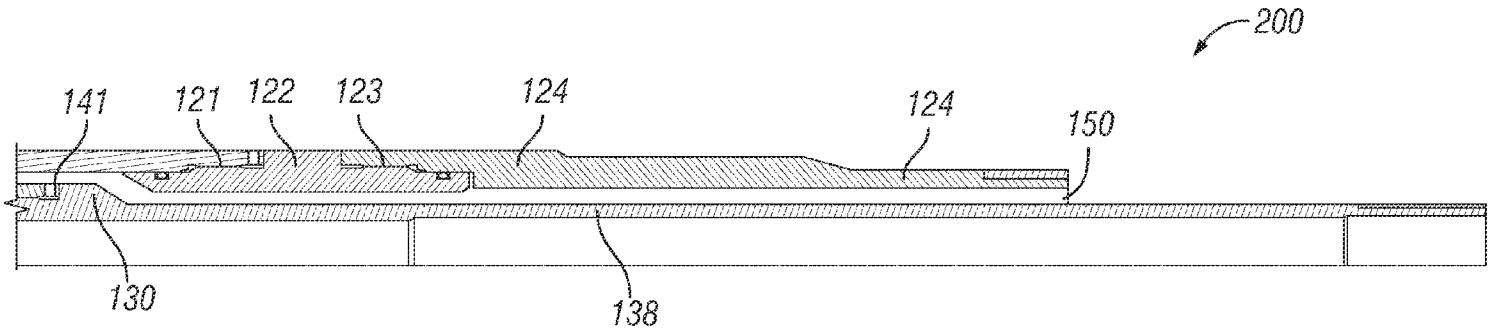
Figure 7E:
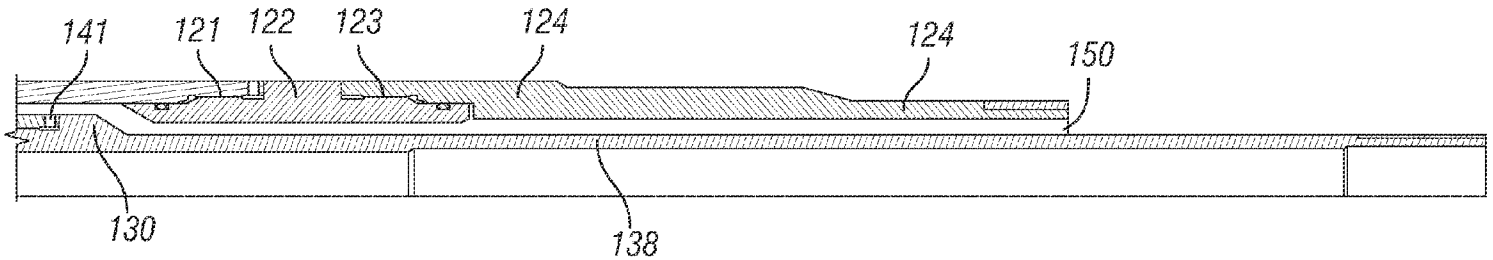
Figure 8E:
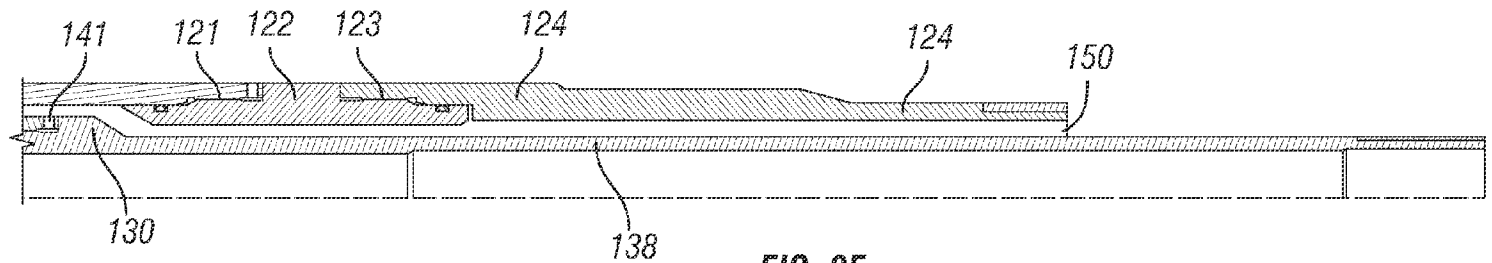

FIGS. 3A-3C illustrate the PAC 100 in an open configuration, wherein the uphole end is on the left and the downhole end is on the right. The valve is opened by bleeding, i.e., reducing, the pressure in the inner bore 151. When the inner bore pressure is bled off, the compressed spring 154 expands against the lower end of the valve piston 162 pushing the valve piston 162, and thus the closing sleeve 144, upwardly until the closing sleeve fluid ports 148 are aligned with the fluid ports 133 allowing fluid to flow from the annular space 150 between the inner housing 130 and the outer housing 101 to the inner bore or tube 151 of the PAC 100.

Referring now to FIGS. 4A-8E, a cross-sectional side view of one embodiment of a valve opening mechanism for a pressure actuated sleeve valve 200 ("PAV") according to the present disclosure is shown. The construction and operation of the PAV 200 is similar to the construction and operation of the PAC 100 described above. The PAV 200 valve opening mechanism and operation allows the fluid pressure in the inner bore or tube to be increased and decreased (bled) for several cycles, for example five cycles, prior to opening the valve. In contrast, the opening mechanism and operation of PAC 100 opened the valve at the end of a single pressurize and bleed cycle.

PAV 200 generally comprises an outer housing or tube 201 constructed of several housing and connecting sections. A top connector housing 202 is disposed at the upper end of the PAV 200. The upper or uphole end of the PAV 200 is on the left and the lower or downhole end is on the right as shown in the various figures. The top connector housing 202 includes a coupling portion at its top end (not shown) for receiving and coupling to uphole tubing or other components such as portions of an isolation string (not shown). At the lower end of the top connector housing 202, the upper end of upper body connector 204 is received by an internally threaded portion 203 thereby coupling the upper body connector 204 to the top connector housing 202. Release piston housing 206 is coupled to the lower end of the upper body connector 204 and to the upper end of a lower body connector 208. Housing extension 210 is coupled to the lower end of the lower body connector 208 and to the upper end of an upper body section 214. Each end of the housing extension 210 is internally threaded to engage externally threaded portions 211 and 213 at the lower end of the lower body connector 208 and the housing upper body section 214, respectively. The lower section of PAV 200 below housing upper body section 214 is similar to the lower section of PAC 100 below housing upper body section 114.

As described above with reference to FIGS. 1A-3C, a closing sleeve 144 covers fluid ports 133 and has a number of fluid ports 148 formed through and around the circumference of the closing sleeve 144 below the fluid ports 133. To open the valve, the closing sleeve 144 is allowed to move in an upwardly direction within the valve body until the closing sleeve fluid ports 148 are aligned with the fluid ports 133. The closing sleeve 144 is secured to the valve piston 162 at its upper end by one or more shear screws 164 about the inner circumstance of the valve piston 162. A piston cap 166 is mounted at the upper end of the piston valve 162 by threaded portion 167. The closing sleeve 144 is retained in position covering the fluid ports 133 by one or more actuatable members, such as spring-biased dogs 168, for example, mounted in an upper portion of upper body section 214 and extending into slot 170 formed about the outer circumference of the valve piston 162. A release sleeve 216 is slidably disposed within and concentric to outer housing 201. A release sleeve extension 217 extends into annular space 218 formed between housing extension 210, and piston cap 166 and an upper end portion 220 of upper body section 214. The release sleeve extension 217 covers and extends a predetermined distance, several inches, for example, below the spring-biased dogs 168 preventing the dogs 168 from retracting from slot 170.

Figure 9:
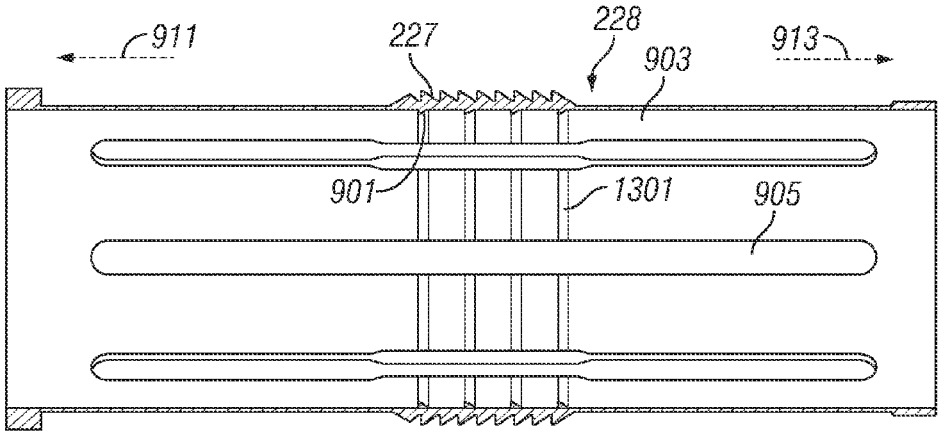
FIG. 9 is a side cross-section view of a double-ended ratchet collet 228 used in one embodiment of a double ratchet mechanism shown in FIGS. 4A-8E.
Figure 11:
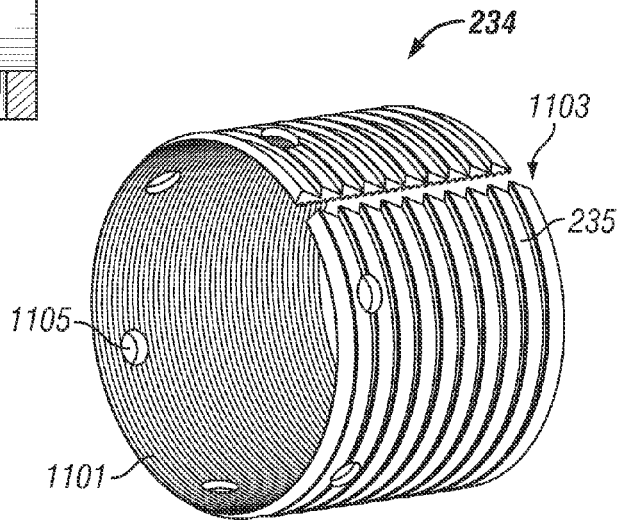
FIG. 11 is an isometric view of a body lock ring 234 used in one embodiment of a double ratchet mechanism shown in FIGS. 4A-8E.
Figure 12:
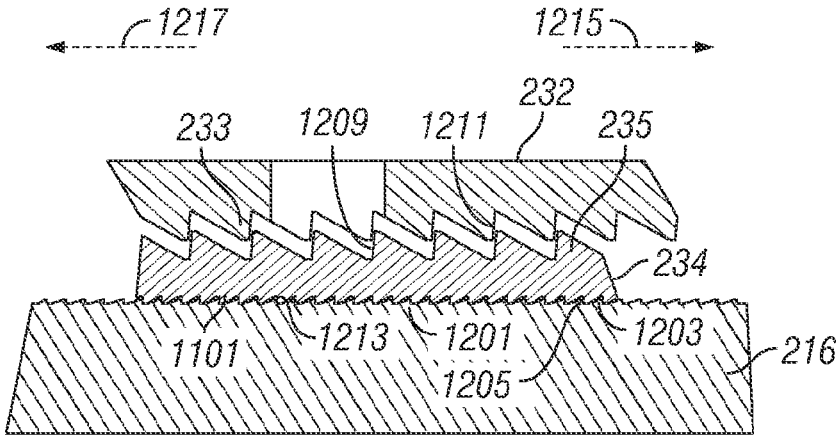
FIG. 12 is a cross-section view of one embodiment of the outer engaging teeth of the body lock ring 234 that engage the body lock ring carrier 232 and inner teeth that engage the release sleeve 216 shown in FIGS. 4A-8E.
Figure 13A:
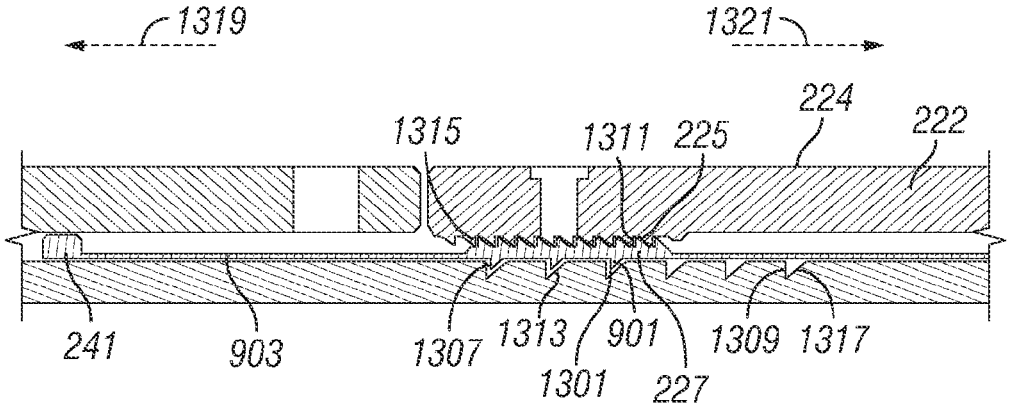
FIG. 13A is a cross-section view of one embodiment of the outer engaging teeth of the double-ended ratchet collet 228 that engage the ratchet collet carrier 224 and inner teeth that engage the release sleeve 216 shown in FIGS. 4A-8E.
Figure 13B:
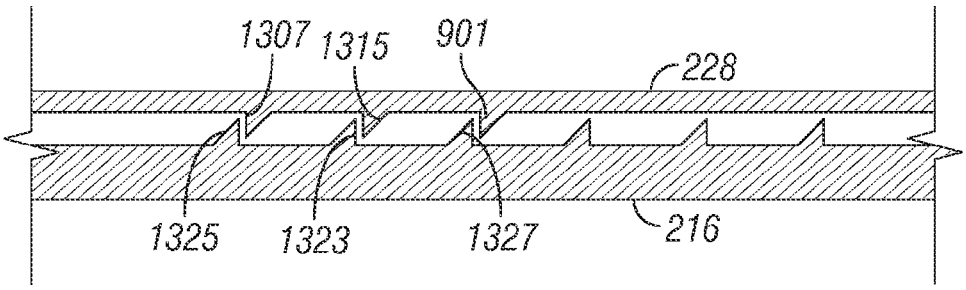
FIG. 13B is a cross-section view of another embodiment of the release sleeve 216 teeth that engage the inner teeth of the double-ended ratchet collet 228.
Figure 14A:
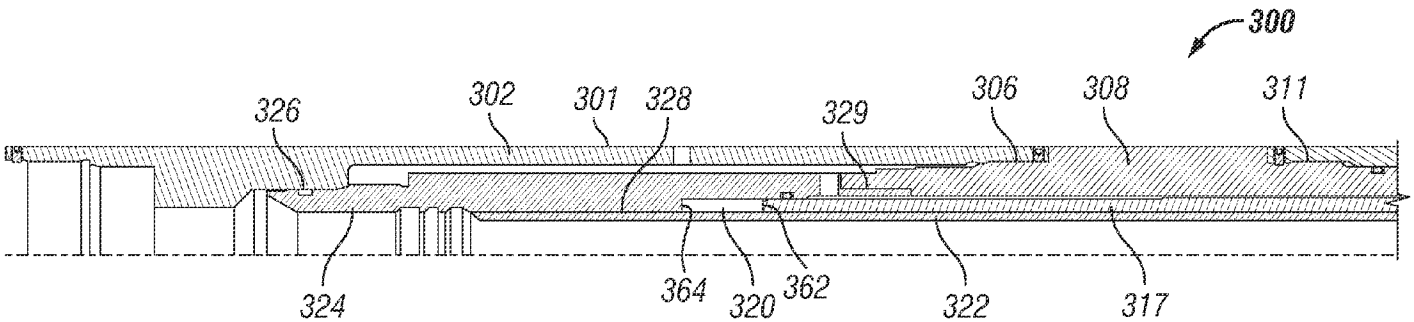
FIGS. 14A-14E illustrate a cross-sectional side view of another embodiment of a valve opening mechanism for a pressure actuated sleeve valve in a locked-closed configuration.
Figure 15A:
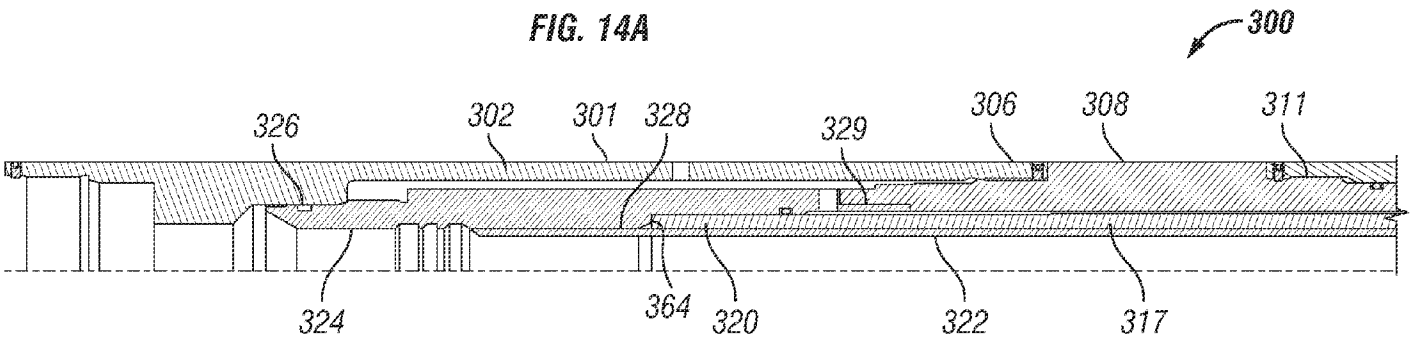
FIGS. 15A-15E illustrate a cross-sectional side view of the valve opening mechanism for a pressure actuated sleeve valve in a locked-closed configuration after a first tubing pressure applied cycle shown in the embodiment of FIGS. 14A-14E.
Figure 16A:
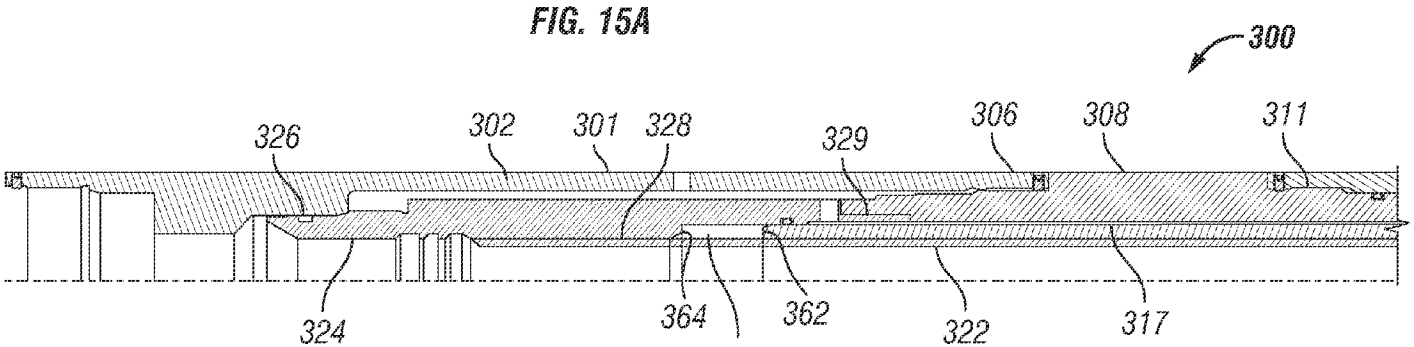
FIGS. 16A-16E illustrate a cross-sectional side view of the valve opening mechanism for a pressure actuated sleeve valve in a locked-closed configuration after a first tubing pressure bleed cycle of the embodiment shown in FIGS. 14A-14E.
Figure 14B:
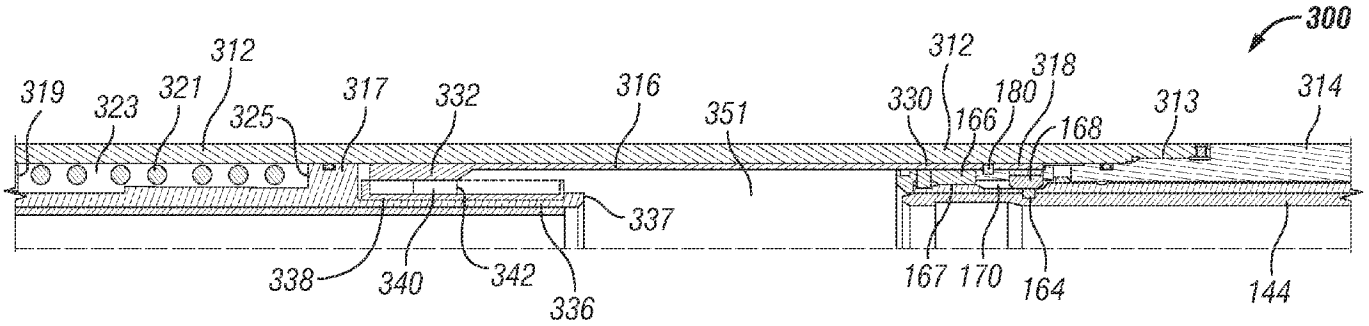
Figure 15B:
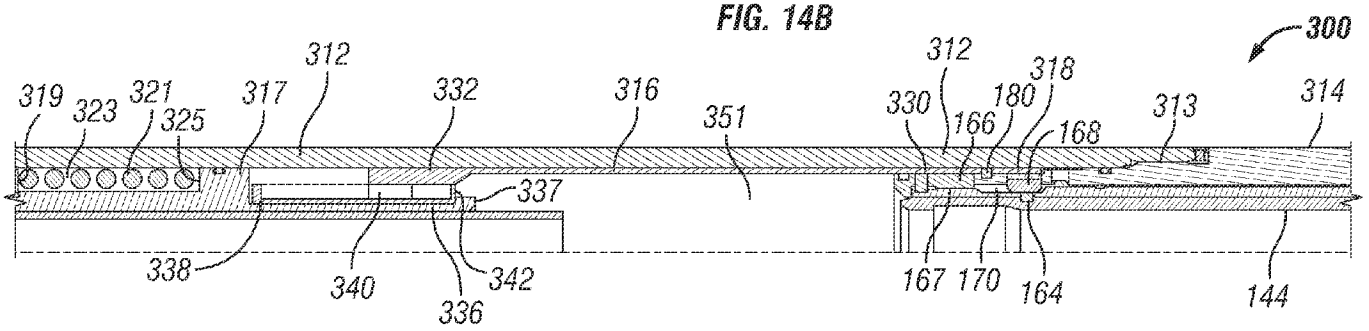
Figure 16B:
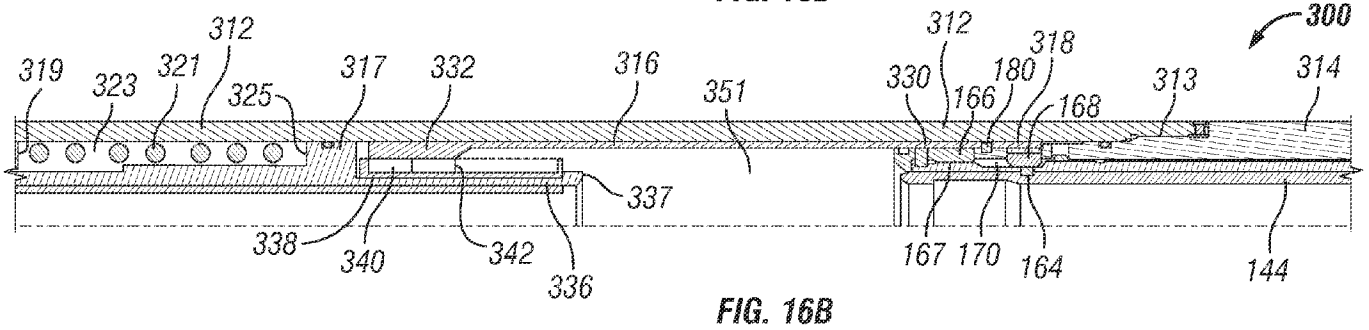
Figure 14C:
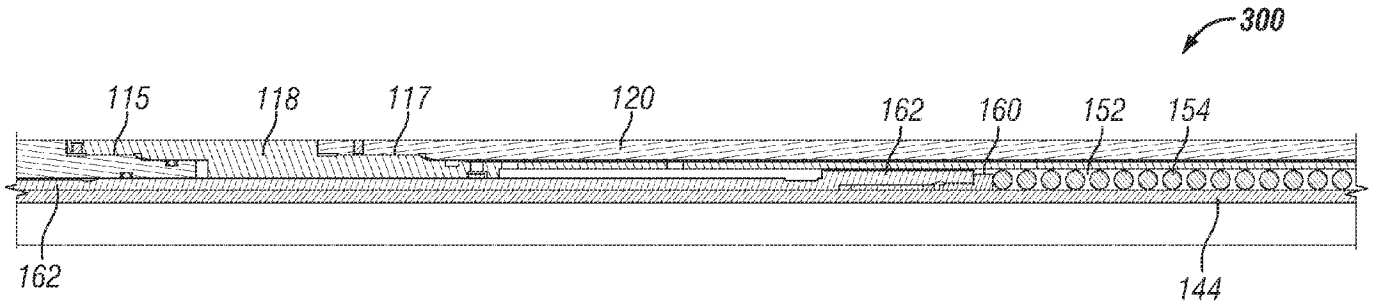
Figure 15C:
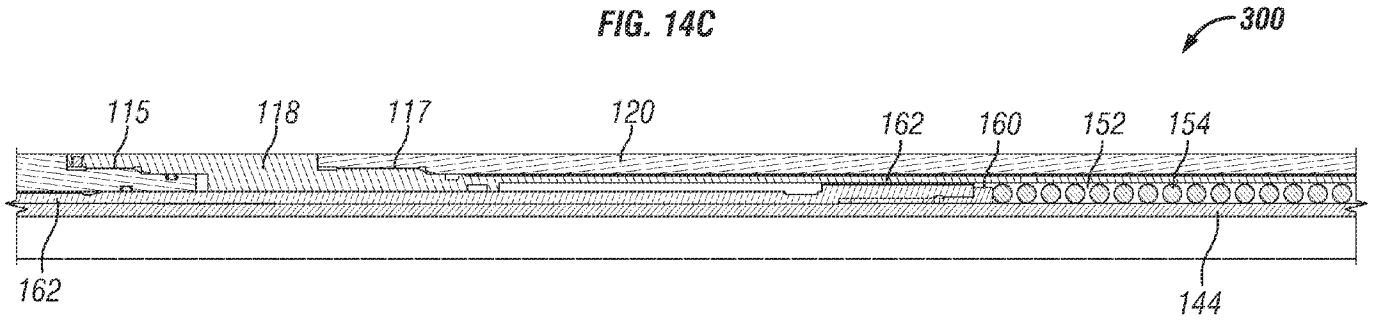
Figure 16C:
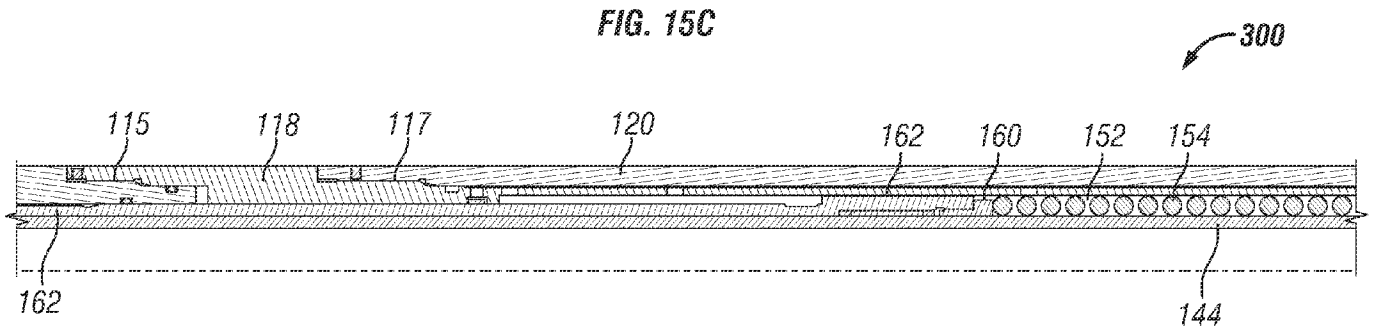
Figure 14D:
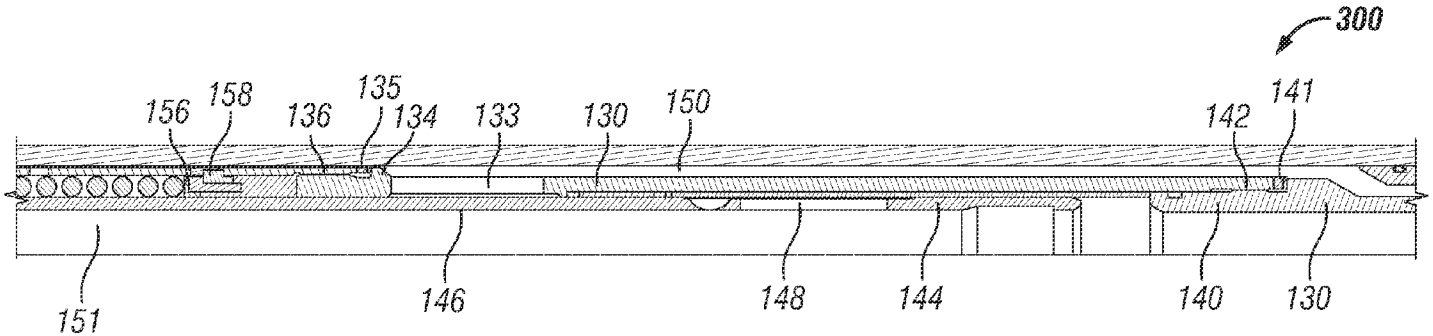
Figure 15D:
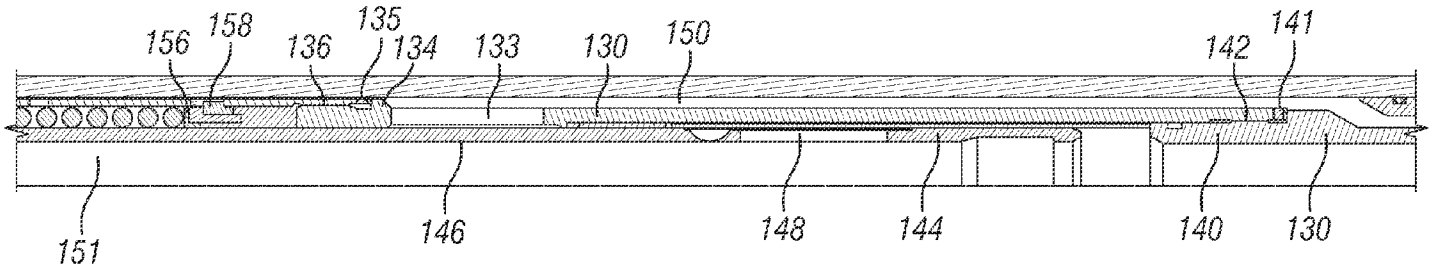
Figure 16D:
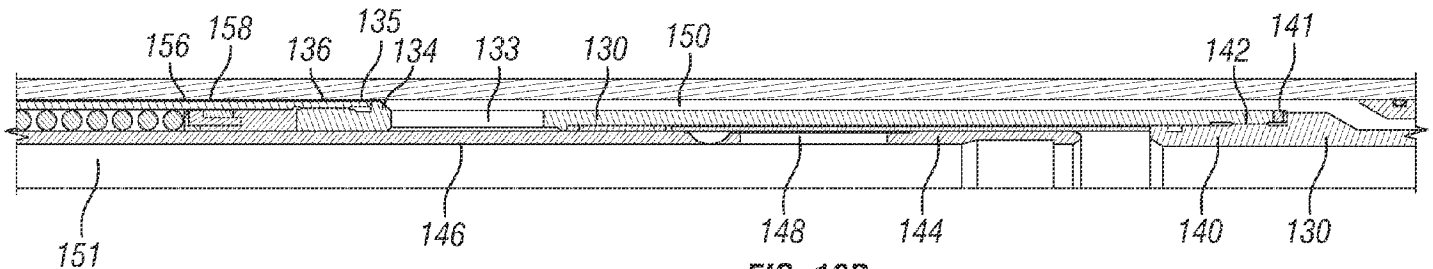
Figure 14E:
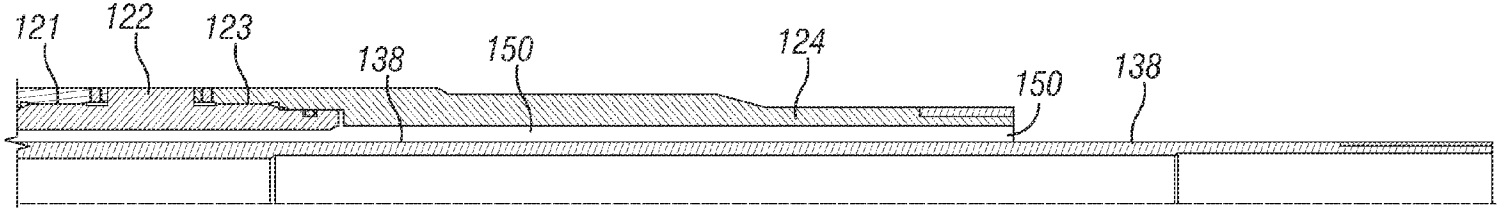
Figure 15E:
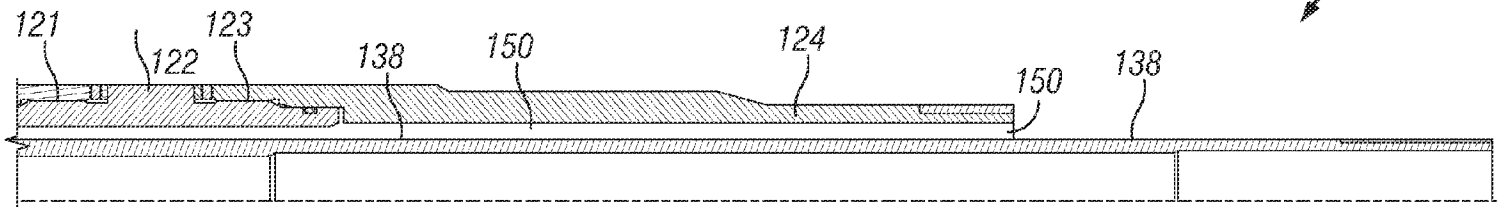
Figure 16E:
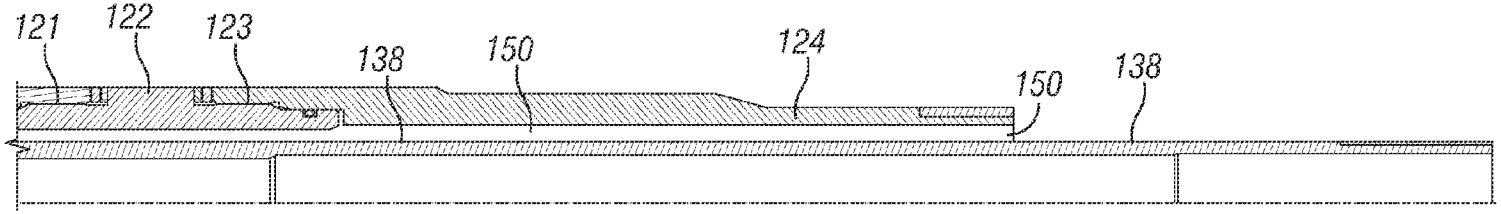
Figure 17A:
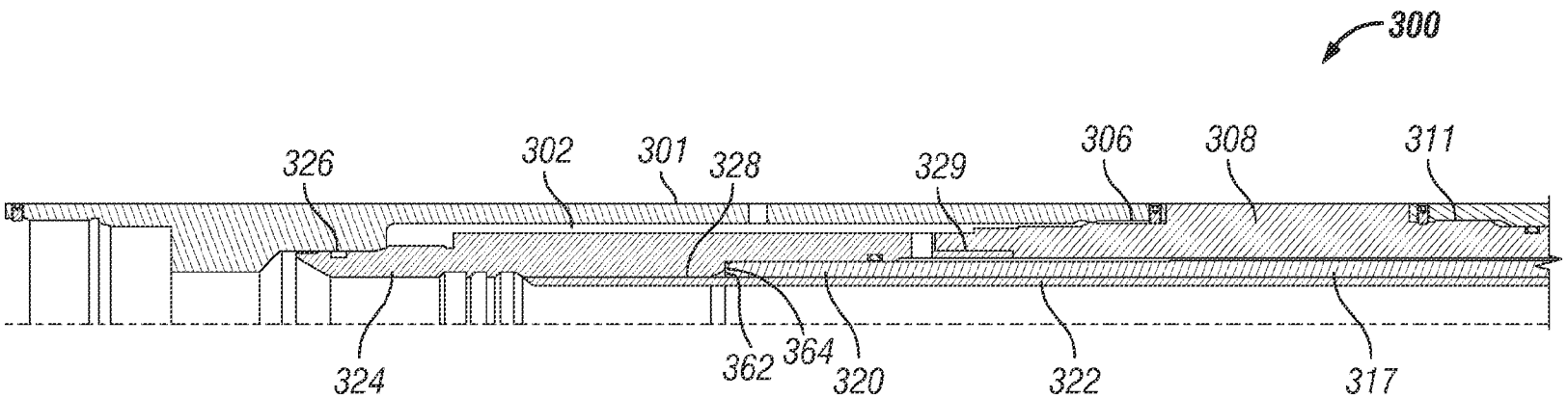
FIGS. 17A-17E illustrate a cross-sectional side view of the valve opening mechanism for a pressure actuated sleeve valve in an unlocked-closed configuration after a final tubing pressure applied cycle shown in the embodiment of FIGS. 14A-14E.
Figure 18A:
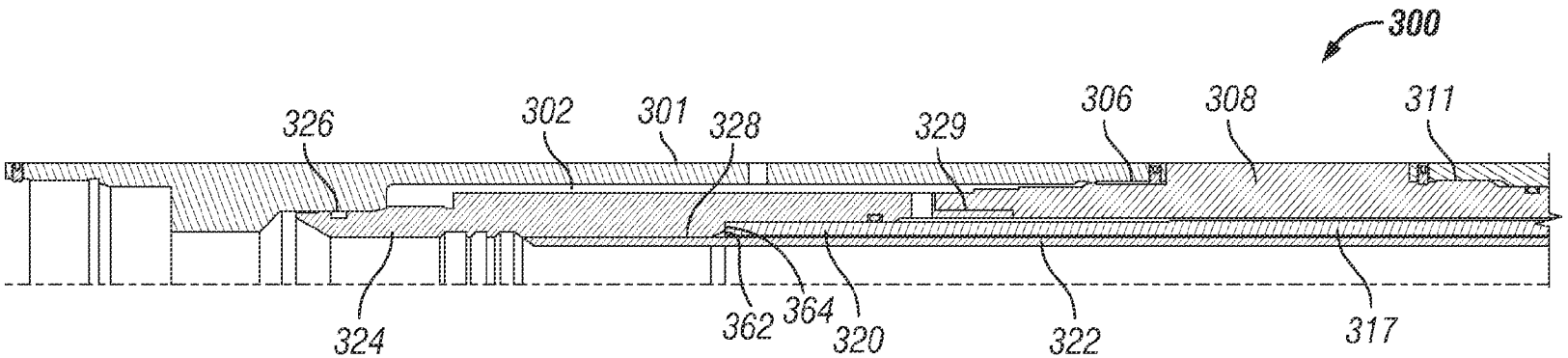
FIGS. 18A-18E illustrate a cross-sectional side view of the valve opening mechanism for a pressure actuated sleeve valve in an open configuration after a final tubing pressure bleed cycle shown in the embodiment of FIGS. 14A-14E.
Figure 17B:
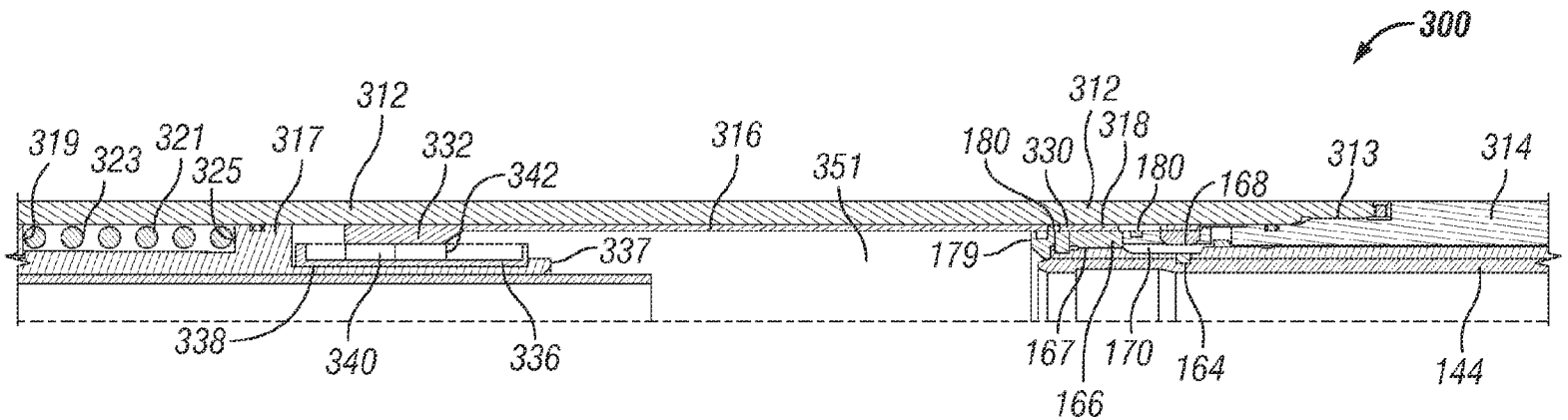
Figure 18B:
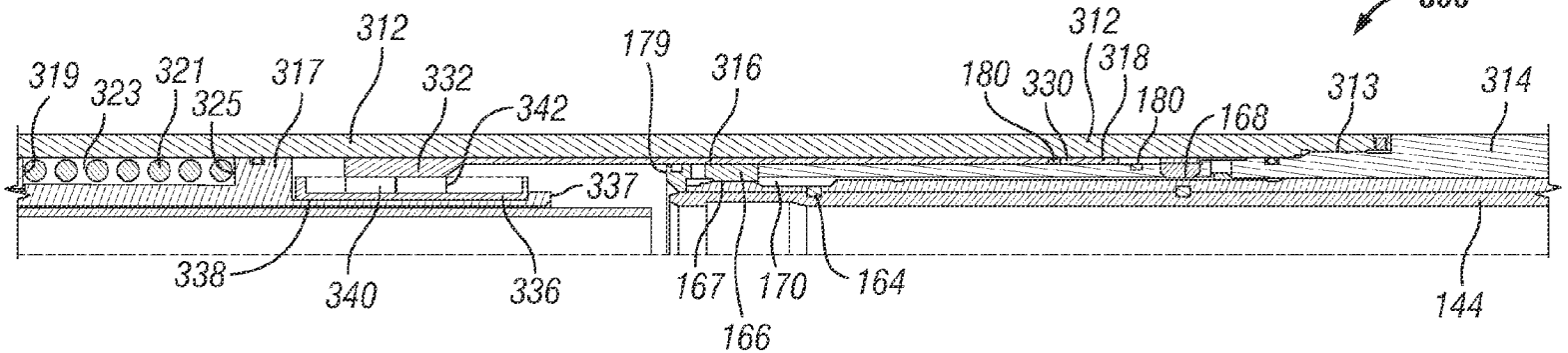
Figure 17C:
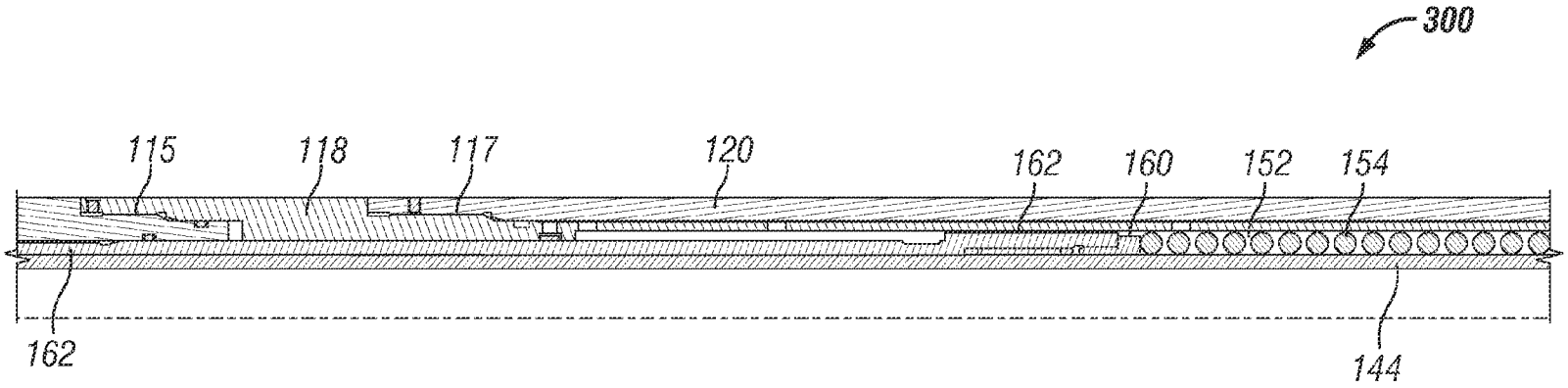
Figure 18C:
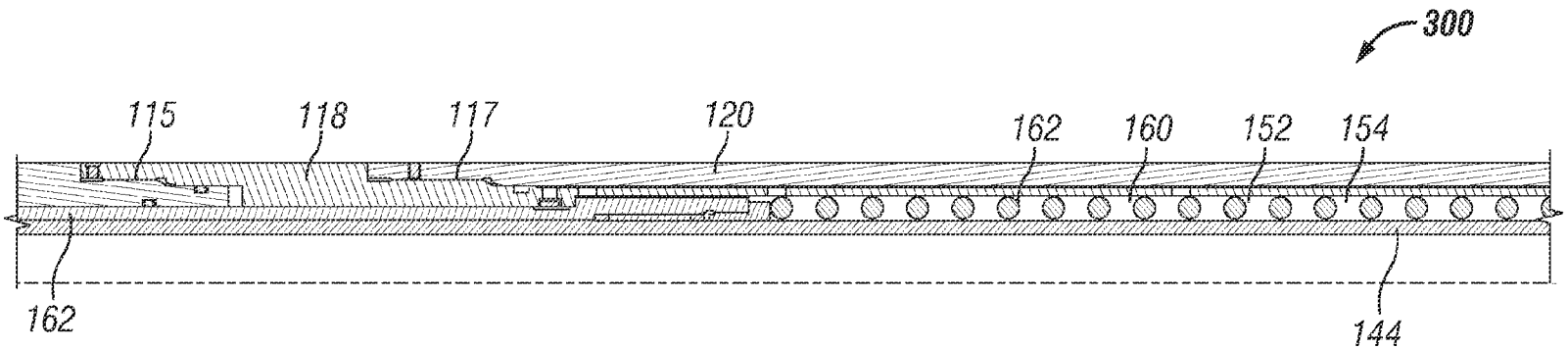
Figure 17D:
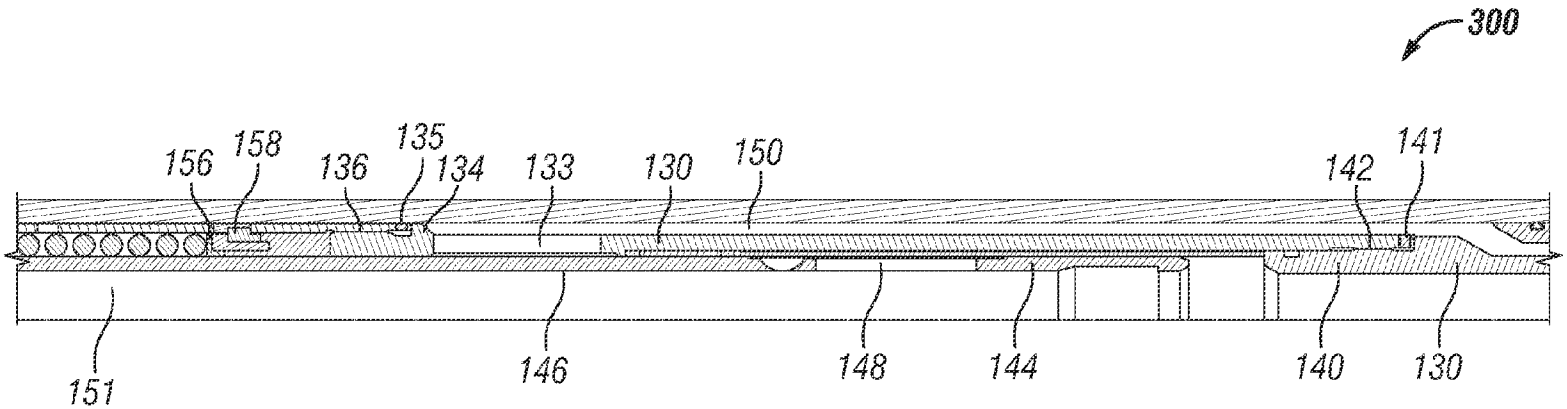
Figure 18D:
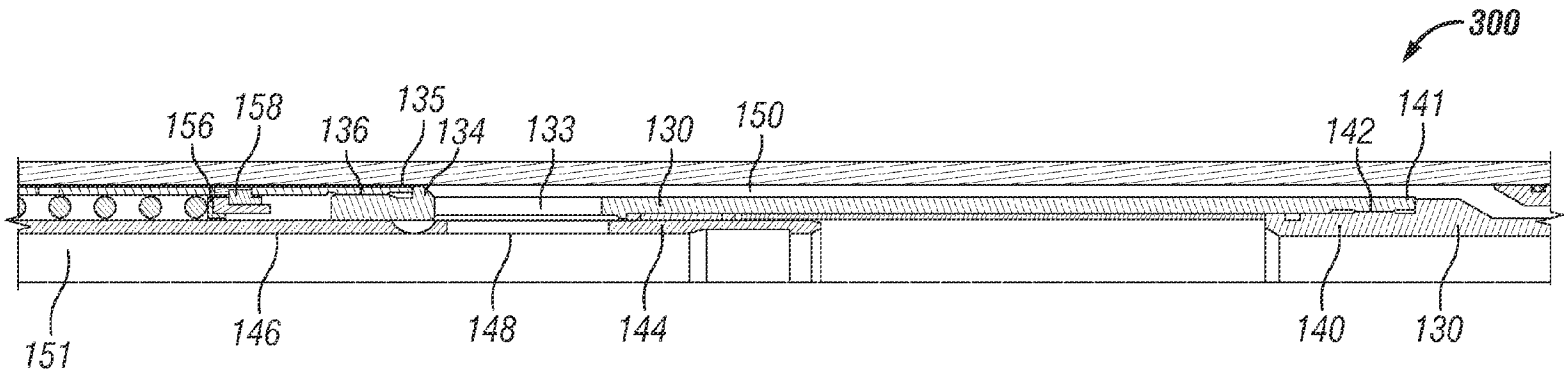
Figure 17E:
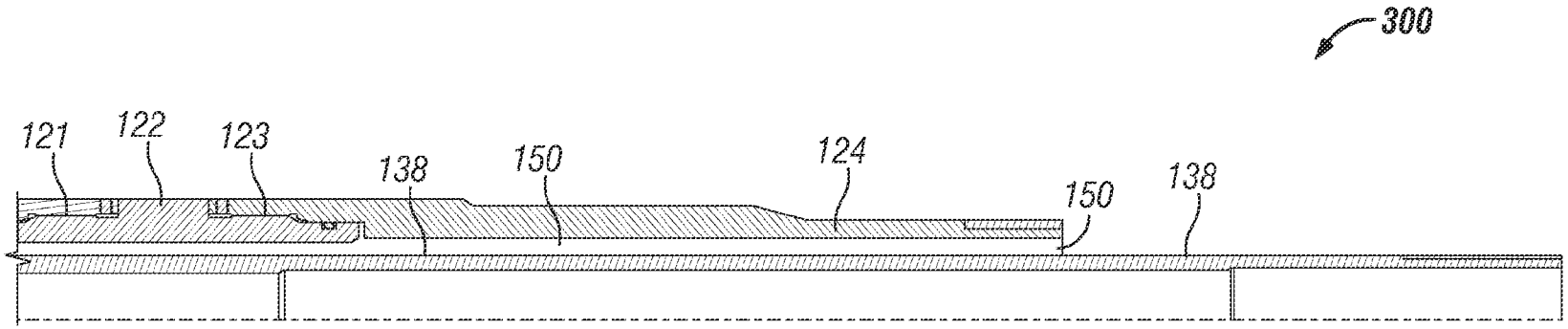
Figure 18E:
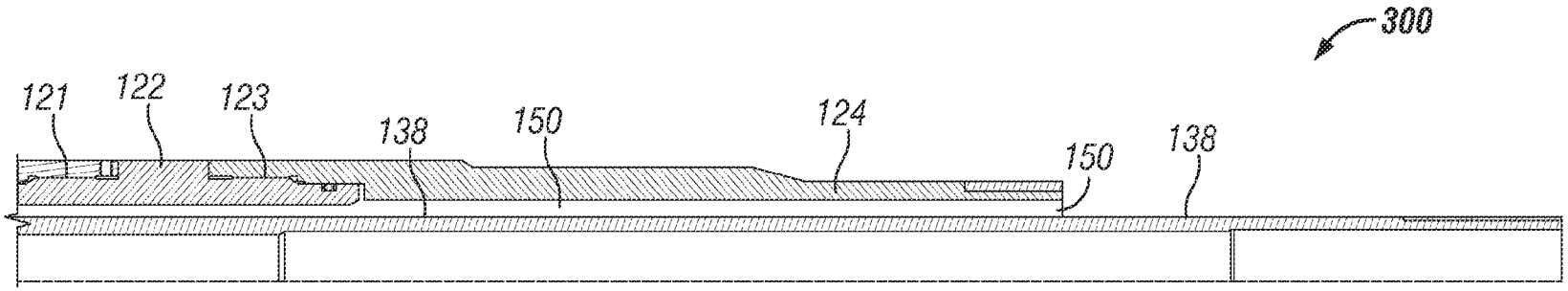

A release piston 222 is slidably disposed within the annular space formed between the release sleeve 216, and lower body connector 208 and release piston housing 206. A ratchet carrier 224 near the upper end of release piston 222 includes ratchet teeth 225 formed around at least a portion of the surface of the inner circumference of the ratchet carrier 224. The ratchet carrier 224 may be formed integrally with the release piston 222 or may be a separate component fixed or fastened to the upper end of release piston 222. A double-ended ratchet collet 228 is placed between the release piston 222 and the release sleeve 216 concentric to and surrounding the release sleeve 216 for at least a portion of the outer circumference. The double-ended ratchet collet 228 is attached to a collet holder 229 between the release piston 222 and the release piston retainer ring 226 by set screw 237, for example. Ratchet teeth 227 formed on the outer surface double-ended ratchet collet 228 opposite the ratchet carrier 224 engage the ratchet teeth 225 formed in the inner surface of the ratchet carrier 224. As shown in FIGS. 9, 13A and 13B, teeth 901 formed on the inner surface of double-ended ratchet collet 228 engage teeth or shaped slots 1301 formed on the outer surface of release sleeve 216. A first spring 230 (or simply "spring 230" below) is disposed in the annular space formed between the release sleeve 216 and release piston housing 206. The upper end of spring 230 bears against the lower end face 231 of upper body connector 204 while the lower end of spring 230 bears against release piston retainer ring 226 biasing the release piston 222 in a downwardly direction. A body lock ring carrier 232 at the lower end of upper body connector 204 includes ratchet teeth 233 formed in the inner surface for at least a portion of the inner circumference of the body lock ring carrier 232. A body lock ring 234 is placed between the release piston 222 and the release sleeve 216 concentric to and surrounding the release sleeve 216 for at least a portion of the outer circumference of the release sleeve 216. Ratchet teeth 235 formed on the outer surface of body lock ring 234 opposite the body lock ring carrier 232 engage the ratchet teeth 233 formed in the inner placed between the release piston 222 and the release sleeve 216 concentric to and surrounding surface of the body lock ring carrier 232. As shown in FIGS. 11 and 12, teeth 1101 formed on the inner surface of body lock ring 234 engage teeth 1201 formed on the outer surface of release sleeve 216.

Typically, the PAV 200 is run into a wellbore in a locked-closed configuration, as shown in FIGS. 4A-4E. In the locked-closed configuration, the closing sleeve 144 covers the fluid ports 133, and the second spring 154 (or simply "spring 154" below) is compressed biasing the valve piston 162 in an upwardly direction. The release sleeve extension 217 covers the spring-biased dogs 168 maintaining them in slot 170 in the valve piston 162 and preventing the valve piston 162, and thus the closing sleeve 144, from moving upwards. The release sleeve extension 217 is held in place by one or more shear pins 180 protruding from a portion 221 of the upper end 220 of the upper body housing section 214 and extending through the release sleeve extension 217.

The PAV 200 may be reconfigured to an unlocked-closed (sheared) configuration, as shown in FIGS. 5A-5E. The PAV 200 is unlocked by creating a pressure differential across the release piston 222 between the annular space or void 236 formed between the release sleeve 216 and lower body connector 208, and the annular space or void 238 formed between the release sleeve 216 and the release piston housing 206. The inner bore 251 of PAV 200 is pressurized by pressuring down the wellbore tubing (not shown) coupled to the upper end of the top connector housing 202. Fluid from the inner bore 251 bleeds into annular space 236 through orifices (not shown) provided in the release sleeve 216 at the corner where the release sleeve 216 joins the release sleeve extension 217 asserting increased pressure against the face 240 of release piston 222. Vents (not shown) vent the annular space 238 to the annular area formed between the outer housing 201 and the upper body connector 204 creating a pressure differential across the release piston 222 driving the release piston 222 upwards in the annular space 238 compressing spring 230 against the face 231 of upper body connector 204. As the release piston 222 moves upwards, the ratchet carrier 224 and the double-ended ratchet collet 228 moves in an upwardly direction. As the release piston 222 moves upwardly, the double-ended ratchet collet 228 is forced against the release sleeve 216 such that the teeth 901 formed on the inner surface of double-ended ratchet collet 228 engage teeth 1301 formed on the outer surface of release sleeve 216 moving the release sleeve 216 upwards along with the release piston 222. In addition, as the release sleeve 216 is pulled upwards by the movement of the release piston 222, the body lock ring 234 teeth 1101 slide over the teeth 1201 formed on the outer surface of the release sleeve 216. The release piston 222 moves upwardly a predetermined distance, stopping its upward movement when upper end of the release piston retainer ring 226 contacts and butts against the lower end face 231 of upper body connector 204. As the release sleeve 216 moves upwards, the release sleeve extension 217 slides upwardly a portion of the distance that it extends in the annular space 218 past the spring-biased dogs 168 shearing the shear pin 180. Since the release sleeve extension 217 has only moved a portion of the distance it extends past the spring-biased dogs 168, the dogs 168 remain covered by the release sleeve extension 217 thus preventing any upward movement of the closing sleeve 144.

When the fluid pressure in the PAV 200 inner bore 251 is reduced, the fluid pressure against face 240 of the release piston 222 bleeds off reducing the pressure differential across the release piston 222. The reduced pressure differential allows spring 230 drive the release piston 222 downwards its original unpressurized position against the upper face 242 of lower body connector 208. The downward motion of the release piston 222 allows the teeth 901 of ratchet collet 232 to slide over the teeth 903 of release sleeve 216 while the release sleeve body lock ring 234 teeth 1101 engage the teeth 1201 of release sleeve 216 preventing any downward movement of the release sleeve 216 as shown in FIGS. 6A-6E. For each additional pressurize and bleed cycle, the release sleeve 216, and hence the release sleeve extension 217 will move upwards an additional predetermined distance. The distance the release sleeve 222 moves each pressurize/bleed cycle is determined by the distance 244 separating the upper end 246 of the release piston retainer ring 226 and the lower end face 231 of upper body connector 204. The distance 244 is determined by the width of the spring-biased dogs 168. In one embodiment, the release piston 222 moves upward about three-quarters of one inch for each pressurize/bleed cycle. The next to the last pressure/bleed cycle must leave the spring-biased dogs 168 completely covered and the last pressure/bleed cycle must completely uncover the spring-biased dogs 168. In one embodiment, five pressurize/bleed cycles are required to uncover the spring-biased dogs 168. To ensure that the release sleeve 216 moves substantially the same distance for each pressure/bleed cycle, the double-ended ratchet collet 228 teeth 901 are widely spaced so that the double-ended ratchet collet 228 catches one and only one additional tooth 1301 on the release sleeve 216 outer surface for each pressure/bleed cycle.

FIGS. 7A-7E illustrate the PAV 200 configuration after the last pressurize cycle. The release sleeve 216 has now been moved upwards a sufficient distance to withdraw the release sleeve extension 217 from the annular space 218 to uncover the spring-biased dogs 168. Once uncovered, the spring-biased dogs 168 are retracted from slot 170, such as by the action of a leaf spring, for example, in the valve piston 162. Fluid pressure on the face 179 of piston cap 166 overrides the compressed spring 154 preventing the closing sleeve 144 from sliding upwardly and opening the fluid ports 133.

The PAV 200 is opened by bleeding, i.e., reducing, the pressure in the inner bore 251 as shown in FIGS. 8A-8E. When the inner bore pressure is bled off, the compressed spring 154 expands against the lower end of the valve piston 162 pushing the valve piston 162, and thus the closing sleeve 144, upwardly until the closing sleeve fluid ports 148 are aligned with the fluid ports 133 opening the valve.

Referring now to FIG. 9, an isometric view, wherein arrow 911 indicates the upwards or uphole direction and arrow 913 indicates the downwards or downhole direction, of a double-ended ratchet collet 228 of one embodiment of the present disclosure is shown. The double-ended ratchet collet 228 includes longitudinal collet segments 903 separated by longitudinal slots 905 located around the circumference of the collet. The number and width of the longitudinal collet segments 903 may be varied depending on the application using the double ratchet mechanism. The interior surface of each collet segment 903 includes teeth 901 that are adapted to selectively engage the teeth 1301 formed on the outer surface of release sleeve 216. The teeth 1301 form a thread, such as a buttress thread, for example, around the outside diameter of release sleeve 216. Teeth 901 are relatively widely spaced to ensure that only one additional tooth 1301 is picked up for each additional pressurize/bleed cycle. The exterior surface of each collet segment 903 includes teeth 227 to engage with the teeth 225 formed in the inner surface of the ratchet carrier 224.

Figure 10:
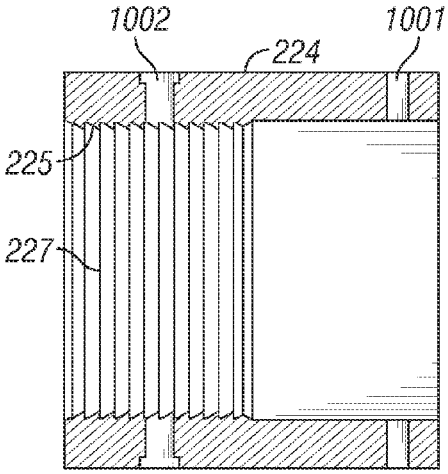
FIG. 10 is a side cross-section view of a ratchet collet carrier 224 used in conjunction with the double-ended ratchet collet 228 of FIG. 9.

Referring now to FIG. 10, one embodiment in accordance with the present disclosure of a ratchet collet carrier 224 is shown. The ratchet collet carrier 224 includes teeth 225 on the interior or inner surface, the teeth 225 being adapted to engage with the teeth 227 located on the collet fingers 903. Openings 1001 around the perimeter of the ratchet collet carrier 224 may be used in one embodiment to secure the ratchet collet carrier 224 to the upper end of the release piston 222 by locking pins or set screws (not shown), for example. In some embodiments, a locking pin (not shown), for example, may be inserted through slot 1002 formed around the perimeter of the ratchet collet carrier 224 into a receiving slot (not shown) formed in the outside surface of ratchet collet 228 to prevent any relative rotation between ratchet collet carrier 224 and ratchet collet 228.

Referring now to FIG. 11, an isometric view of a body lock ring 234 of one embodiment of the present disclosure is shown. The interior surface of the body lock ring 234 includes teeth 1101 that are adapted to selectively engage the teeth 2101 formed in the outer surface of release sleeve 216. The body lock ring 234 includes a gap 1103 the formed in the body. The gap 1103 allows the body lock ring 234 to expand as it ratchets over the teeth 1201 on the release sleeve 216 (as shown in greater detail in FIG. 12). The gap 1103 aids in the selective engagement of teeth 1101 with teeth 1201 of the release sleeve 216. The exterior or outer surface of the body lock ring 234 includes teeth 235 adapted to engage with the teeth 233 formed on the inner surface of body lock ring carrier 232. The body lock ring 234 may include openings 1105 around the perimeter to aid in connecting the body lock ring 234 to the body lock ring holder 241 using locking pins or set screws (not shown), for example. Body lock rings are typically fabricated with the inner diameter small enough such that the inner threads clamp onto a mandrel such as the threaded portion of the release sleeve 216, for example.

Referring now to FIG. 12, a cross-sectional view of the teeth of the body lock ring 234 according to one embodiment of the present disclosure is shown. The exterior surface of the body lock ring 234 includes teeth 235 that are adapted to engage the teeth 233 of the body lock ring carrier 232. The body lock ring carrier 232 may be constructed similarly to ratchet collet carrier 224 as shown in FIG. 10. The interior surface of the body lock ring 234 includes teeth 1101 that are adapted to engage the teeth 1201 on the outer surface of the release sleeve 216. When pressure is applied moving the release piston 222 upwards carrying the release sleeve 216 with it, an angle substantially less than 90 degrees for the upwards face 1203 of the teeth 1201 allows the release sleeve 216 to move in an upwards direction, as shown by arrow 1207 sliding past the body lock ring 234. As the release sleeve 216 moves upward, as shown by arrow 1217, the body lock ring 234 is forced outwardly towards the body lock ring carrier 232, the substantially 90 degree face 1209 of the teeth 235 on the outer surface of the body lock ring 234 engaging an opposing substantially 90 degree face 1211 of the teeth 233 on the interior surface of the body lock ring carrier 232. When pressure on the release piston 222 is bled, i.e., reduced, the spring 230 forces the release piston 222 in a downwards direction. Any corresponding downwards motion of the release sleeve 216, as shown by the arrow 1215, is prevented by a substantially 90 degree face 1205 of the release sleeve teeth 1201 engaging with an opposing substantially 90 degree face 1213 of the teeth 1101 formed on the interior surface of the body lock ring 234. Thus the body lock ring 234 acts to allow an upwards motion of the release sleeve 216 but prevents any downwards motion to return the release sleeve 216 to its original position. Conventional body lock rings, and corresponding body lock ring carriers, have a 90 degree face on both the inner and outer face. However, the 90 degree angles may actually only be about 85 degrees to allow the body lock ring, and corresponding body lock ring carrier, to be manufactured more easily. The body lock ring 234 in conjunction with the body lock ring carrier 223 of the present disclosure will allow the release sleeve to ratchet in one direction 1217 and will prevent movement of the release sleeve 216 when it is pushed in the other direction 1215.

Referring now to FIG. 13A, a cross-section view of one embodiment of the outer engaging teeth 227 of the double-ended ratchet collet 228 that engage the teeth 225 of the ratchet collet carrier 224 and inner teeth 901 that engage the shaped slots 1301 formed in the surface of the release sleeve 216 is shown. When pressure is applied moving the release piston 222 upwards carrying the release sleeve 216 with it, as shown by arrow 1319, an angle substantially less than 90 degrees for the downwards face 1305 of the ratchet collet carrier 224 teeth 225 engages the downwards face 1303 of the double-ended ratchet collet 228 teeth 227 forcing the collet fingers 903 inwardly against the outer surface of the release sleeve 216. The substantially 90 degree upwards face 1307 of teeth 901 formed on the inner surface of ratchet collect 228 engage the substantially 90 degree face 1309 of shaped slots 1301 formed on the outer surface of release sleeve 216 pulling the release sleeve 216 upwards, as shown by arrow 1319, as the release piston 222 is forced upwards. When pressure on the release piston 222 is bled, i.e., reduced, the spring 230 forces the release piston 222 in a downwards direction as shown by arrow 1321. The substantially 90 degree upwards face 1311 of the ratchet collet carrier 224 teeth 225 engage the substantially 90 degree face 1313 of the ratchet collect 228 outer teeth 227 pulling the double-ended ratchet collet 228 in a downwards direction. Since the release sleeve 216 is prevented from moving in a downwards direction by the locking action of the body lock ring 234 engaging the release sleeve 216 teeth 1201, an angle substantially less than 90 degrees for the both downwards face 1315 of the ratchet collet carrier 224 inner teeth 901 and the downwards face 1317 of the shaped slot 1301 formed in the surface of the release sleeve allows the ratchet collet fingers 903 to expand outwardly pulling the double-ended ratchet collet 228 inner teeth 901 away from the release sleeve surface and out of the shaped slots 1301.

Referring now to FIG. 13B, as will be appreciated by those of skill in the art, in another embodiment of the present disclosure the shaped slots 1301 formed in the surface of the release sleeve 216 may be teeth 1327 protruding from the outer surface of the release sleeve 216 adapted to engage the inner teeth 901 of the double-ended ratchet collet 228. When pressure is applied moving the release piston 222 upwards carrying the release sleeve 216 with it, as shown by arrow 1319, the substantially 90 degree upwards face 1307 of teeth 901 formed on the inner surface of ratchet collect 228 engage the substantially 90 degree downwards face 1323 of teeth 1327 formed on the outer surface of release sleeve 216 pulling the release sleeve 216 upwards, as shown by arrow 1319. When pressure on the release piston 222 is bled, i.e., reduced, the spring 230 forces the release piston 222 in a downwards direction as shown by arrow 1321. Since the release sleeve 216 is prevented from moving downwards by the locking action of the body lock ring 234 engaging the release sleeve 216 teeth 1201, as the release piston 222 pulls the double-ended ratchet collet 228 downwards, an angle substantially less than 90 degrees for the both the downwards face 1315 of the ratchet collet carrier 224 inner teeth 901 and the upwards face 1325 of the teeth 1327 formed in the surface of the release sleeve 216 allows the ratchet collet fingers 903 to expand outwardly pulling the double-ended ratchet collet 228 inner teeth 901 away from the release sleeve surface allowing the ratchet collet inner teeth 901 to slide over the release sleeve teeth 1327.

Referring now to FIGS. 14A-18E, a cross-sectional side view of another embodiment of a valve opening mechanism for a pressure actuated sleeve valve 300 ("PAV") according to the present disclosure is shown. The construction and operation of the PAV 300 is similar to the construction and operation of the PAC 100 described above. Similar to PAV 200, described above, the PAV 300 valve opening mechanism and operation allows the fluid pressure in the inner bore or tube to be increased and decreased (bled) for several cycles, for example five cycles, prior to opening the valve.

PAV 300 generally comprises an outer housing or tube 301 constructed of several housing and connecting sections. A top connector housing 302 is disposed at the upper end of the PAV 300. The upper or uphole end of the PAV 300 is on the left and the lower or downhole end is on the right as shown in the various figures. The top connector housing 302 includes a coupling portion at its top end for receiving and coupling to uphole tubing (not shown) or other components such as portions of an isolation string (not shown). At the lower end of the top connector housing 302, the upper end of a release piston carrier 308 is received by an internally threaded portion 306 thereby coupling the release piston carrier 308 to the top connector housing 302. Housing extension 312 is coupled to the lower end of the release piston carrier 308 and to the upper end of an upper body section 314. Each end of the housing extension 312 is internally threaded to engage externally threaded portions 311 and 313 at the lower end of the release piston carrier 308 and the housing upper body section 314, respectively. The lower section of PAV 300 (not shown) below housing upper body section 314 is similar to the lower section of PAC 100 below housing upper body section 114.

As described above, a closing sleeve 144 covers fluid ports 133 and has a number of fluid ports 148 formed through and around the circumference of the closing sleeve 144 below the fluid ports 133. To open the valve, the closing sleeve 144 is allowed to move in an upwardly direction within the valve body until the closing sleeve fluid ports 148 are aligned with the fluid ports 133. The closing sleeve 144 is secured to the valve piston 162 at its upper end by one or more set screws 164 about the inner circumstance of the valve piston 162. A piston cap 166 is mounted at the upper end of the piston valve 162 by threaded portion 167. The closing sleeve 144 is retained in position covering the fluid ports 133 by one or more actuatable members, such as spring-biased dogs 168, for example, mounted in an upper portion of upper body section 314 and extending into slot 170 formed about the outer circumference of the valve piston 162. A release piston 317 is slidably disposed within annular space 320 formed between the release piston carrier 308 and inner adapter 324, respectively, and inner sleeve 322 Inner adapter 324 is disposed within and concentric to top connector 302, and is coupled to top connector 302 by set screws 326 or other suitable coupler. The lower end of inner adapter 324 is coupled to the upper end of release piston carrier 308 at threaded portion 329. Inner sleeve 322 is coupled to the inner adapter 324 at threaded portion 328. A spring 321 disposed in the annular space 323 formed between the release piston 317 and housing extension 312 bears against the upper face 325 of release piston 317 and the lower face 319 of release piston carrier 308. A release sleeve 316 extends into annular space 318 formed between housing extension 312 and piston cap 166. The lower end 330 of release sleeve 316 covers the spring-biased dogs 168 preventing the dogs 168 from retracting from slot 170, preventing the closing sleeve from moving upwards in the valve body. The release sleeve 316 is held in place by shear pin 180 extending through release sleeve 316 into piston cap 166.

The upper end 332 of release sleeve 316 extends into annular space 334 formed between housing extension 312 and release sleeve extension 336 extending from the lower face 338 of release piston 317. A rotating ratchet mechanism 340 is disposed between the release sleeve upper end 332 and the release piston extension 336 and is adapted to rotate in a radial direction about the release piston extension 336. A mounting bracket 342 slidably mounts rotating ratchet mechanism 340 to release piston extension 336 allowing the release piston extension 336 to move upwardly or downwardly as the release piston 317 moves upwardly or downwardly in annular space 320 while also allowing the rotating ratchet mechanism 340 to rotate about release piston extension 336 between release piston 336 and release sleeve upper end 332.

Figure 19B:
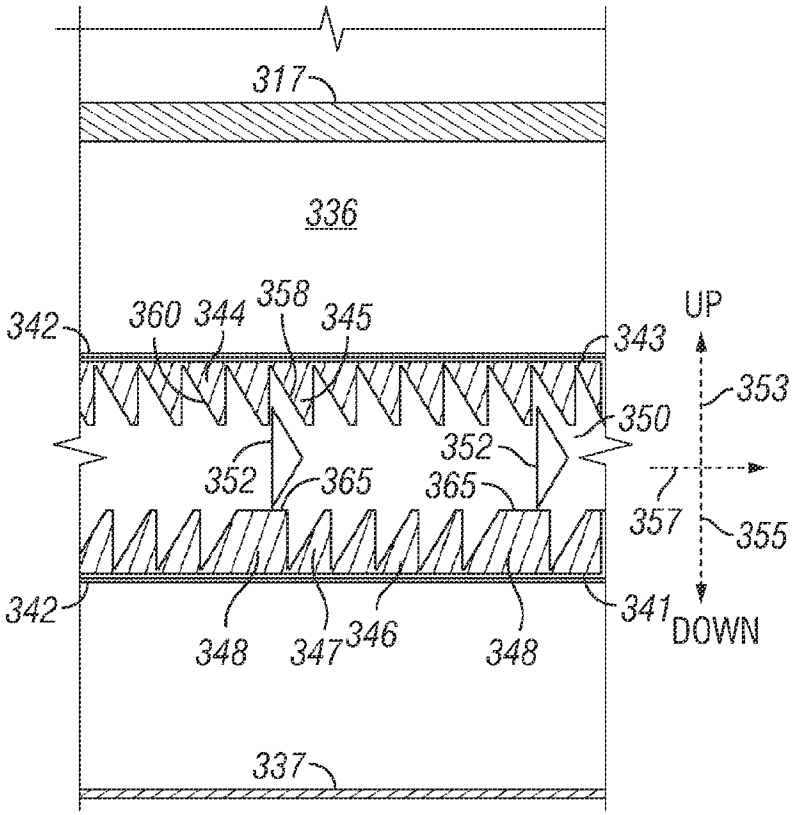
FIGS. 19A and 19B illustrate a top view of the rotating ratchet mechanism of the embodiment shown in FIGS. 14A-18E.
Figure 19A:
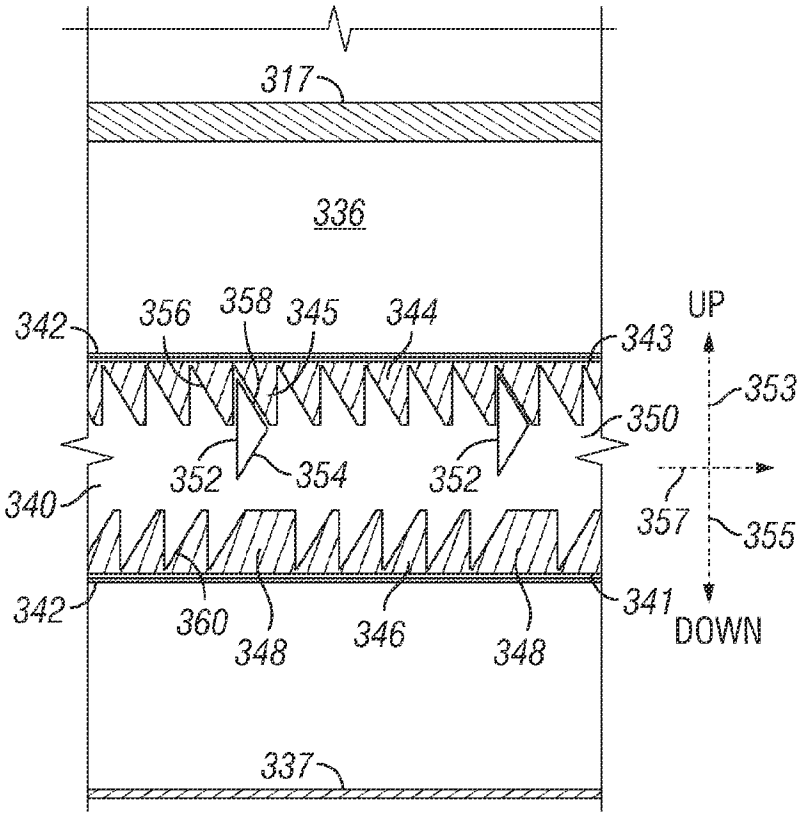

Referring now also to FIGS. 19A and 19B, a top view of the rotating ratchet mechanism 340 is shown. Two annular toothed rings 344 and 346 are fixed in opposing fashion in an annular case 350. Annular case 350 is rotatably mounted to the release piston extension 336 by mounts 342. Upper annular ring 344 is fixedly mounted to the uphole or upwards wall 343 of annular case 350 and comprises a number of teeth 345 formed in the annular ring at a predetermined pitch. Similarly, lower annular ring 346 is fixedly mounted to the downhole or downwards wall 341 of annular case 350 and comprises a number of teeth 347 formed in the annular ring at the same pitch and opposing the teeth 345 formed in upper annular ring 344. Stops 348 are also formed at regular intervals, such as every five teeth, for example, between the teeth 347 of lower annular ring 346. Lugs 352 formed on the inner surface of and at predetermined intervals about the inner circumference of release sleeve upper end 332 are adapted to mesh and engage teeth 345 and 347 formed on annular rings 344 and 346, respectively. Lugs 352 may be an integral part of the release sleeve upper end 332 or may be separate components fixedly attached to the release sleeve upper end 332.

A pressure increase in the tubing inner bore 351 will force the release piston 317 in an upwards direction moving the rotating ratchet mechanism 340 in an upwards direction engaging the fixed lugs 352. Since the release sleeve 316 is held in position by shear screw 180, the lugs 352 remain stationary as the rotating ratchet mechanism 340 moves. As the rotating ratchet mechanism 340 moves in an upwards direction, as indicated by arrow 353, the angled face 354 will engage the similarly angled face 360 of teeth 345 or of stop 348 causing the ratchet mechanism 340 to rotate a predetermined amount, such as about 18 degrees, for example, in the direction indicated by arrow 357. Bleeding or reducing the pressure in tubing inner bore 351 allows pressure from the exterior of the valve and the compressed spring 321 to force the release piston 317 downwards moving the rotating ratchet mechanism 340 in a downwards direction. As the rotating ratchet mechanism 340 moves downwards, as indicated by arrow 355, the angled face 358 of lugs 352 will engage the similarly angled face 356 of teeth 345 causing the ratchet mechanism 340 to further rotate approximately the same amount, such as about 18 degrees, for example, in the same direction as indicated by arrow 357.

Typically, the PAV 300 is run into a wellbore in a locked-closed configuration, as shown in FIGS. 14A-14E. In the locked-closed configuration, the closing sleeve 144 covers the fluid ports 133, and the spring 154 is compressed biasing the valve piston 162 in an upwardly direction. The release sleeve extension 330 covers the spring-biased dogs 168 maintaining them in slot 170 in the valve piston 162 and preventing the valve piston 162, and thus the closing sleeve 144, from moving upwards. The release sleeve 316 is held in place by shear pin 180 extending through release sleeve extension 330 into piston cap 166. The lugs 352 are positioned at the upper extent of the release piston downwards travel in the valve and are engaged with the teeth 345 against the upper annular ring 344.

The PAV 300 may be reconfigured to an unlocked-closed (sheared) configuration, as shown in FIGS. 17A-17E. The PAV 300 is unlocked by repeatedly pressurizing and then bleeding the pressure in the tubing inner bore 351. Increasing the pressure in the inner bore 351 creates a pressure differential across the release piston 317 between the tubing inner bore 351 and the annular space or void 320 formed between the inner sleeve 322 and inner adapter 324, and the annular space or void 323 formed between the release piston 317 and the housing extension 312. The inner bore 351 of PAV 300 is pressurized by pressuring down the wellbore resulting in increased pressure against release piston 317 face 338 and release piston extension stop 337. Vents (not shown) vent the annular space 323 to the annular space created between top connector housing 302 and inner adapter 324 (which in turn is vented to the exterior of the valve) creating a pressure differential across the release piston 317 driving the release piston 317 upwards in the annular spaces 320 and 323 and compressing spring 321 against the face 319 of release piston carrier 308. In some embodiments, the annular space created between top connector housing 302 and inner adapter 324 may be vented to the zone above. Space 320 is vented to the tubing inner bore 351 through the annular space formed between the release piston 317 and the inner sleeve 322. As the release piston 317 is pushed upwards, the rotating ratchet mechanism 340 moves upwards, as indicated by arrow 353, and the angled face 354 of lugs 352 will engage the similarly angled face 356 of teeth 347 or stop 348 causing the ratchet mechanism 340 to rotate a predetermined amount, such as about 18 degrees, for example, in the direction indicated by arrow 357. The release piston 317 will be forced upwards compressing spring 321 until the release piston upper end 362 abuts the face 364 of inner adapter 324 as shown in FIGS. 15A-15E.

Bleeding or reducing the pressure in tubing inner bore 351 allows pressure from the valve exterior and the compressed spring 321to force the release piston 317 downwards moving the rotating ratchet mechanism 340 downwards. As the rotating ratchet mechanism 340 moves downwards, as indicated by arrow 355, the angled face 358 of lugs 352 will engage the similarly angled face 356 of teeth 345 causing the ratchet mechanism 340 to further rotate approximately the same amount, such as about 18 degrees, for example, in the same direction as indicated by arrow 357. At the end of the first pressurize/bleed cycle, the release piston 317 will return to its original position, as shown in FIGS. 16A-16E, while the release sleeve 316 remains in its original locked position covering the spring-biased dogs 168. The rotating ratchet mechanism 340 has been rotated the angular equivalent of one full tooth width now engaging the lugs 352 by the tooth immediately adjacent to the tooth originally engaging the lugs 352. With each additional pressurize/bleed cycle, rotating ratchet mechanism 340 will rotate one additional tooth width. At the end of the next to the last pressurize/bleed cycle, the annular rings 344, 346 will have rotated a sufficient amount to place the lug stops 348 opposite the lugs 352, as shown in FIG. 19B. On the next, and last, pressurize cycle, as the release piston 317 is driven upwards, the face 365 of the lug stops 348 will impact the lugs 352. As the release piston 317 continues to move upwards, the release sleeve 316 is forced upwards, withdrawing the release sleeve extension 330 shearing the shear pin 180 and uncovering the spring-biased dogs 168 allowing the dogs 168 to retract from slot 170 in the valve piston 162. As long as the tubing inner bore 351 remains pressurized, fluid pressure on the face 179 of piston cap 166 overrides the compressed spring 154 preventing the closing sleeve 144 from sliding upwardly and opening the fluid ports 133.

In the above description, the rotating ratchet mechanism 340 is rotatably attached to the outer surface of the release piston extension 336 adjacent to the release sleeve upper end 332 while the lugs 352 are formed in and extend inwardly from the inner surface of the release sleeve upper end 332 to mesh with the rotating ratchet mechanism 340 teeth 344, 346. In this configuration, the rotating ratchet mechanism 340 moves in an upwards and downwards direction in response to the upwards and downwards movement of the release piston 317, as shown by the arrows 353 and 355, respectively, while the lugs remain stationary with respect to the release sleeve 316. As will be appreciated by those of skill in the art, in another embodiment, rotating ratchet mechanism 340 may be rotatably attached to the release sleeve upper end 332 remaining stationary and not moving in an upwards or downwards direction in response to the movement of the release piston 317. The lugs 352 are formed in the outer surface of the release piston extension 336 and extend outwardly from the outer surface of the release piston extension 336 to mesh with the rotating ratchet mechanism 340 teeth 344, 346. In this embodiment, the lugs 352 move in an upwards and downwards direction in response to the upwards and downwards, as shown by arrows 353 and 355, respectively, motion of the release piston 317.

FIGS. 17A-17E illustrate the PAV 300 configuration after the last pressurize cycle. The PAV 300 is shown in the unlocked-closed configuration. Fluid pressure on the face 179 of piston cap 166 overrides the compressed spring 154 preventing the closing sleeve 144 from sliding upwardly and opening the fluid ports 133

PAV 300 is opened by bleeding, i.e., reducing, the pressure in the inner bore 351 as shown in FIGS. 18A-18E. When the inner bore 351 pressure is bled off, the compressed spring 154 expands against the lower end of the valve piston 162 forcing the valve piston 162, and thus the closing sleeve 144, upwardly until the closing sleeve fluid ports 148 are aligned with the fluid ports 133 opening the valve. When the closing sleeve fluid ports 148 are aligned with the fluid ports 133, fluid is able to flow from outside the outer housing 101 via fluid flow path 150 formed between the inner housing 130 and the outer housing 101 through the fluid ports 133 to the tubing inner bore 351.

While the methods and apparatus of this invention have been described in terms of various embodiments, it will be apparent to those of skill in the art that variations may be applied to the methods, apparatus and/or processes, and in the steps or in the sequence of steps of the methods described herein without departing from the concept and scope of the invention. More specifically, it will be apparent that certain features which are both mechanically and functionally related may be substituted for the features described herein while the same or similar results would be achieved. All such similar substitutes and modifications apparent to those skilled in the art are deemed to be within the scope and concept of the invention.

What is claimed is:

1. A pressure actuated valve comprising:

a tubular housing;

at least one port formed in the tubular housing;

a first piston and a second piston, the first and second pistons being independently actuatable relative to one another;

a first biasing mechanism positioned proximate the first piston, the first biasing mechanism being adapted to apply a biasing force to the first piston so as to urge the first piston to move towards an initial position, the first piston adapted to be moved from its initial position to an intermediate position by increasing a pressure within the valve from a first pressure to a second pressure, the first piston moving back to its initial position when the pressure within the valve is decreased to a pressure approximately equal to or less than the first pressure;

a closing sleeve operatively coupled to the second piston, said sleeve adapted to have an initial position so as to cover the at least one port;

a release sleeve coupled to the first piston by a ratchet mechanism and the release sleeve securing the second piston in an initial position;

the ratchet mechanism adapted to allow (i) movement of the release sleeve with the first piston between the initial position and the intermediate position of the first piston and (ii) movement of the first piston back to its initial position without the release sleeve, whereby after a number of cycles of movement of the first piston between its initial position and the intermediate position and back, the release sleeve releases the second piston; and a second biasing mechanism positioned proximate the second piston, the biasing mechanism being adapted to apply a biasing force to the second piston so as to urge the second piston to move toward a final position so as to uncover the at least one port.

2. The pressure actuated valve of claim 1, further comprising:

the release sleeve having an outer and inner diameter, the release sleeve outer diameter being less than an inner diameter of the tubular housing, the tubular housing having a proximal end and a distal end, the tubular housing surrounding the release sleeve, and further comprising;

an inner adapter having an outer diameter and an inner diameter, the outer diameter less than the inner diameter of the tubular housing inner diameter, the inner adapter adjacent the distal end of the tubular housing; and an inner sleeve having an outer diameter less that the inner diameter of the inner adapter, the inner sleeve disposed adjacent the inner adapter, an annular void formed between the proximal end of the tubular housing and the inner sleeve, the first piston being disposed within the annular void adjacent to the tubular housing and the inner sleeve, the first piston being moveable in the annular void, the first biasing mechanism disposed within the annular void between the inner adapter and the first piston.

3. The pressure actuated valve of claim 1, wherein the ratchet mechanism comprises a double ratchet assembly adapted for moving the release sleeve in a first direction responsive to the movement of the first piston in the first direction between its initial position and the intermediate position and preventing movement of the release sleeve in a second direction responsive to the movement of the first piston in the second direction between the intermediate position and its initial position.

4. The pressure actuated valve of claim 1, wherein the release sleeve is operatively coupled to the second piston by a plurality of shear pins.

5. The pressure actuated valve of claim 1, further comprising a plurality of actuatable members that engage the release sleeve and the second piston when the first and second pistons are in their initial positions and thereby secure the second piston in its initial position.

6. The pressure actuated valve of claim 5, wherein the plurality of actuatable members comprise a plurality of spring actuated dogs.

7. The pressure actuated valve of claim 3, wherein the release sleeve has an outer diameter and an outer surface, the release sleeve outer diameter being less than an inner diameter of the tubular housing, the tubular housing having a proximal end and a distal end, the housing assembly surrounding the release sleeve, the first piston disposed within an annular space formed between the tubular housing and the release sleeve, the first piston being moveable in the annular space, the first biasing mechanism being disposed within the annular space and between the proximal end of the tubular housing and the first piston, the first biasing mechanism biasing the first piston in the second direction, the double ratchet mechanism comprising:

a first ratchet mechanism having an inner and outer surface, the inner surface of the first ratchet mechanism adapted to selectively engage the release sleeve;

a first ratchet carrier having an inner surface adapted to selectively engage the outer surface of the first ratchet mechanism, the first ratchet carrier adapted to move the release sleeve in a first direction in response to movement of the first piston in the first direction;

a second ratchet mechanism having an inner and outer surface, the inner surface of the second ratchet mechanism adapted to selectively engage the release sleeve; and a second ratchet carrier having an inner surface adapted to selectively engage the outer surface of the second ratchet mechanism, the second ratchet carrier preventing movement of the release sleeve in the second direction in response to movement of the first piston in the second direction.

8. A pressure actuated valve comprising:

a tubular housing;

at least one port formed in the tubular housing;

a first piston and a second piston, the first and second pistons being independently actuatable relative to one another;

a closing sleeve operatively coupled to the second piston, said sleeve adapted to have an initial position so as to cover the at least one port;

a release sleeve releasably coupling the first piston to the second piston, the second piston being secured in an initial position by way of the release sleeve; and a ratchet mechanism operated by movement of the first piston between an initial position and an intermediate position and back to its initial position, the ratchet mechanism causing sufficient movement of the release sleeve to release the second piston after a number of cycles of movement of the first piston between its initial position and the intermediate position and back.

9. The pressure actuated valve of claim 8, wherein the ratchet mechanism comprises a double ratchet assembly adapted for moving the release sleeve in a first direction responsive to the movement of the first piston in the first direction between its initial position and the intermediate position and preventing movement of the release sleeve in a second direction responsive to the movement of the first piston in the second direction between the intermediate position and its initial position.

10. The pressure actuated valve of claim 9, wherein the release sleeve has an outer diameter and an outer surface, the release sleeve outer diameter being less than an inner diameter of the tubular housing, the tubular housing having a proximal end and a distal end, the tubular housing surrounding the release sleeve, the first piston disposed between the tubular housing and the release sleeve, the double ratchet mechanism comprising:

a first ratchet mechanism having an inner and outer surface, the inner surface of the first ratchet mechanism adapted to selectively engage the release sleeve;

a first ratchet carrier having an inner surface adapted to selectively engage the outer surface of the first ratchet mechanism, the first ratchet carrier adapted to move the release sleeve in a first direction in response to movement of the first piston in the first direction;

a second ratchet mechanism having an inner and outer surface, the inner surface of the second ratchet mechanism adapted to selectively engage the release sleeve; and a second ratchet carrier having an inner surface adapted to selectively engage the outer surface of the second ratchet mechanism, the second ratchet carrier preventing movement of the release sleeve in the second direction in response to movement of the first piston in the second direction.

11. The pressure actuated valve of claim 8 further comprising a first biasing mechanism being a first spring positioned proximate the first piston, the first spring biasing the first piston in the second direction.

12. The pressure actuated valve of claim 8 further comprising a second biasing mechanism positioned proximate the second piston, the biasing mechanism being spring adapted to apply a biasing force to the second piston so as to urge the second piston to move toward a final position so as to uncover the at least one port.

13. The pressure actuated valve of claim 1, wherein the closing sleeve and the second piston are releasably coupled separate elements.

14. The pressure actuated valve of claim 13, wherein the closing sleeve is secured to the valve piston by at least one shear screw.

15. The pressure actuated valve of claim 1, wherein the closing sleeve is secured to the valve piston by at least one set screw.

16. The pressure actuated valve of claim 8, wherein the closing sleeve and the second piston are releasably coupled separate elements.

17. The pressure actuated valve of claim 16, wherein the closing sleeve is secured to the second piston by at least one shear screw.

18. The pressure actuated valve of claim 8, wherein the closing sleeve is secured to the second piston by at least one set screw.

19. The pressure activated valve of claim 8, wherein after the number of cycles of movement of the first piston is complete, the closing sleeve moves to uncover the at least one port.

20. The pressure activated valve of claim 8, the tubular housing includes an inner bore and pressurizing fluid in the inner bore creates a pressure differential between the inner bore and the well bore annulus, thereby imparting movement to the first piston.

21. The pressure activated valve of claim 8, wherein the uncovering of the at least one port prevents the pressurizing of fluid in the inner bore, thereby preventing the second piston from moving to re-cover the at least one port and close the valve.

22. The pressure activated valve of claim 8, wherein the tubular housing is an inner tubular housing and inner tubular housing is surrounded by an outer housing.

23. The pressure activated valve of claim 8, wherein the ratchet mechanism rotates with each movement of the first piston and the release sleeve moves only after a number of cycles of the first piston.

* * * * *